US009770806B2

(12) United States Patent
Kaga et al.

(10) Patent No.: US 9,770,806 B2
(45) Date of Patent: Sep. 26, 2017

(54) SHOT PROCESSING APPARATUS

(71) Applicant: SINTOKOGIO, LTD., Nagoya-shi, Aichi (JP)

(72) Inventors: Hideaki Kaga, Toyokawa (JP); Hiroaki Suzuki, Toyokawa (JP); Shoichi Yamamoto, Toyokawa (JP); Masato Umeoka, Toyokawa (JP); Takuya Koyama, Toyokawa (JP)

(73) Assignee: SINTOKOGIO, LTD., Aichi (JP)

( * ) Notice: Subject to any disclaimer, the term of this patent is extended or adjusted under 35 U.S.C. 154(b) by 0 days.

(21) Appl. No.: 15/142,823

(22) Filed: Apr. 29, 2016

(65) Prior Publication Data

US 2016/0354897 A1 Dec. 8, 2016

Related U.S. Application Data

(63) Continuation of application No. PCT/JP2015/070245, filed on Jul. 15, 2015.

(30) Foreign Application Priority Data

Jul. 22, 2014 (JP) ..... 2014-148967

(51) Int. Cl.
*B24C 3/30* (2006.01)
*B24C 5/06* (2006.01)
(Continued)

(52) U.S. Cl.
CPC ..... *B24C 3/30* (2013.01); *B24B 31/023* (2013.01); *B24C 3/26* (2013.01); *B24C 5/06* (2013.01)

(58) Field of Classification Search
CPC .... B24C 3/26; B24C 3/30; B24C 5/06; B24B 31/023; B24B 31/104
(Continued)

(56) References Cited

U.S. PATENT DOCUMENTS 2,108,210 A * 2/1938 Rosenberger ..... B24C 3/30 451/102
2,116,160 A * 5/1938 Rosenberger ..... B24C 3/30 451/2
(Continued)

FOREIGN PATENT DOCUMENTS

JP 54-89391 A 7/1979
JP S57-202661 U 12/1982
(Continued)

OTHER PUBLICATIONS

International Search Report, and English language translation thereof, in corresponding International Application No. PCT/JP2015/070245, dated Sep. 15, 2015, 6 pages.

*Primary Examiner* — Eileen Morgan
(74) *Attorney, Agent, or Firm* — Brinks Gilson & Lione

(57) ABSTRACT

The purpose of the present invention is to provide a drum-type shot peening device capable of shortening processing time. This shot peening device comprises: a bottomed, cylindrical drum having one end thereof open; and a projector provided on the open side of the drum and which projects projection material on to a workpiece inserted inside the drum. The projector comprises: a cylindrical control gauge having an opening window that is formed in the side wall thereof and serves as a discharge port for the projection material, said opening window having a rectangular shape having two sides thereof parallel to the center axis of the control gauge having the projection material supplied therein; and an impeller comprising a plurality of blades arranged on the outside of the control gauge so as to extend in the radial outside direction of the control gauge, said impeller rotating around the center axis of the control gauge and having a backward-tilting section that is tilted towards the rear side in the blade rotation direction and is
(Continued)

provided on the surface on the front side in the rotation direction.

4 Claims, 23 Drawing Sheets

(51) Int. Cl.
*B24B 31/023* (2006.01)
*B24C 3/26* (2006.01)

(58) Field of Classification Search
USPC ..... 451/35, 85, 95, 97
See application file for complete search history.

(56) References Cited

U.S. PATENT DOCUMENTS 2,224,647 A * 12/1940 Grocholl ..... B24C 3/04 451/95
2,440,819 A * 5/1948 Evans ..... B24C 3/30 451/3
2,449,745 A * 9/1948 Jewell ..... B24C 3/30 451/86
2,732,666 A * 1/1956 Powell ..... B24C 5/06 451/94
3,694,963 A * 10/1972 Leliaert ..... B24C 5/062 451/97
4,277,965 A * 7/1981 Rutten ..... B24C 5/062 451/98
4,366,690 A 1/1983 Rutten
2013/0017767 A1* 1/2013 Suzuki ..... B24C 3/085 451/86

FOREIGN PATENT DOCUMENTS

JP 61-191862 U 11/1986
JP S61-191862 U 11/1986
JP 62-29254 U 2/1987
JP S62-29254 U 2/1987
JP H08-126959 A 5/1996
JP 2011-110642 A 6/2011
JP 2011-194486 A 10/2011

* cited by examiner

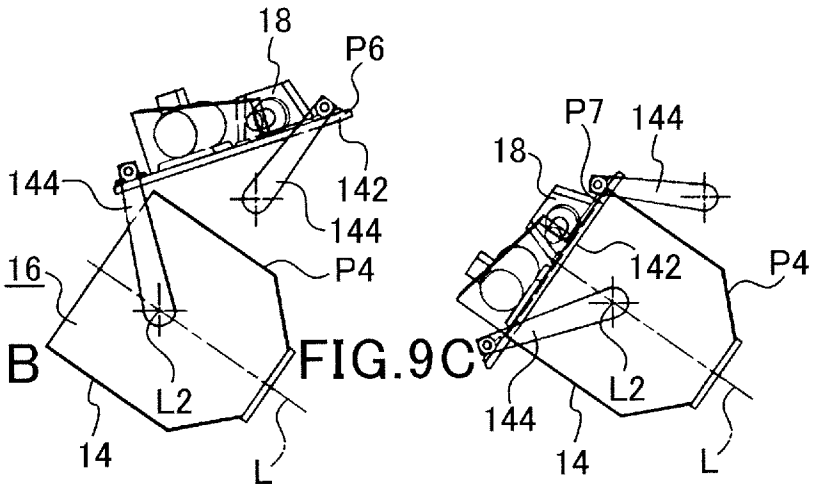
FIG.9C
FIG.9B
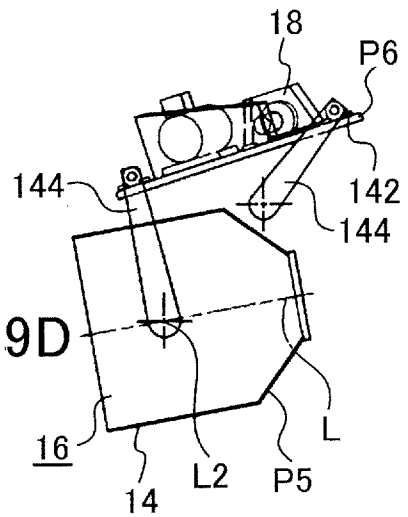
FIG.9D
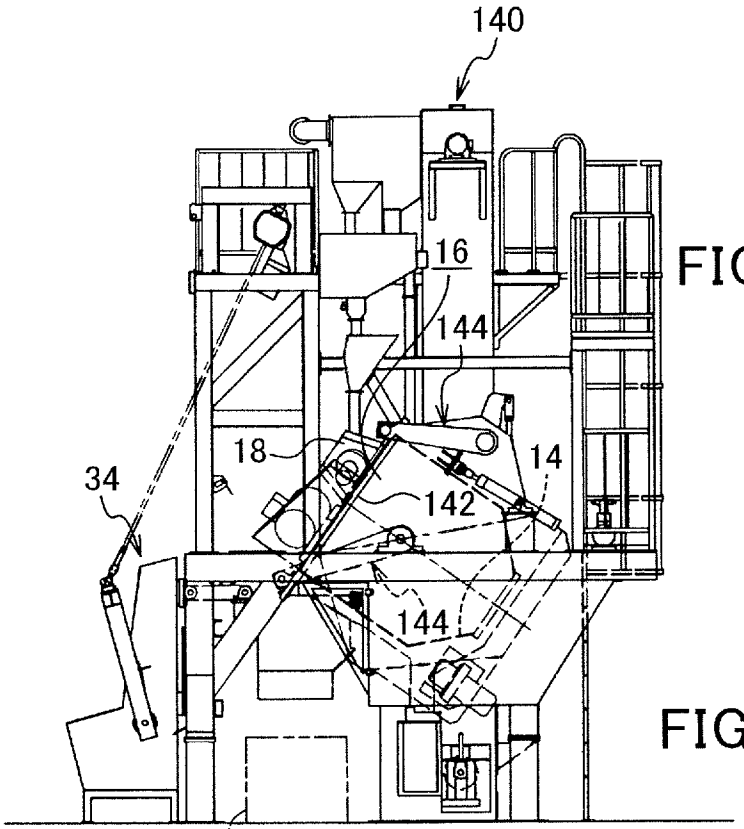
FIG.9A

R 1
O 1
L 1
L 2
L 4
L 5
L 8
P 1
θ 1
B 1
303
303a
303b
303c
303d
303e
303f
303g
303j
303n
303p
303p、303s
303q
303r
303s
303t
303u
310
311
311a
311c
311d
312
317

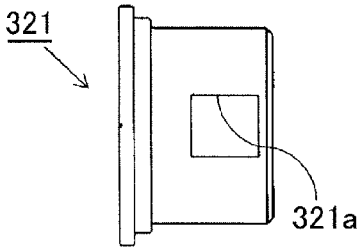
FIG.22A
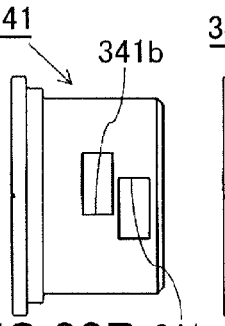
FIG.22B
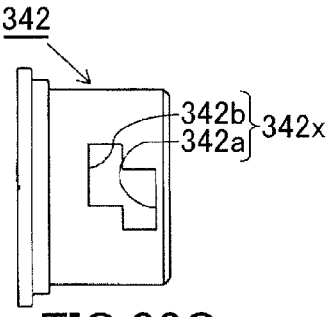
FIG.22C
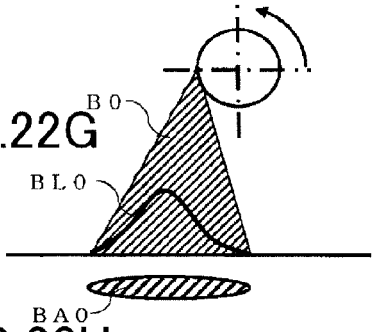
FIG.22G
FIG.22H
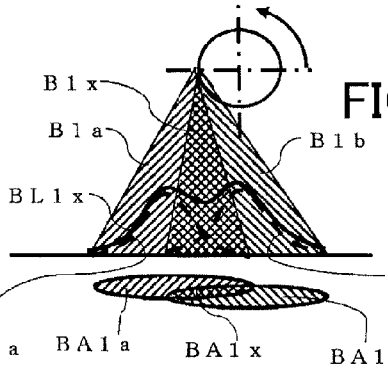
FIG.22I
FIG.22J
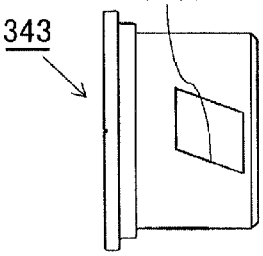
FIG.22D
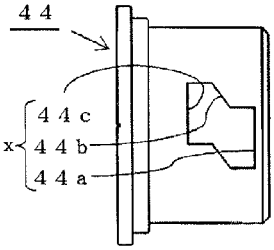
FIG.22E
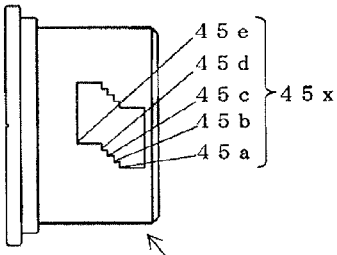
FIG.22F
45
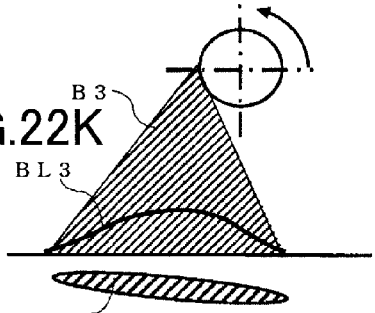
FIG.22K
FIG.22L
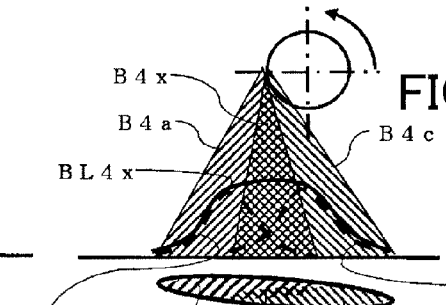
FIG.22M
FIG.22N

SHOT PROCESSING APPARATUS

RELATED APPLICATIONS

The present application is a continuation of International Application PCT/JP2015/070245, with an international filing date of Jul. 15, 2015, which claims priority to Japanese Patent Application No. 2014-148967 filed on Jul. 22, 2014, the entire contents of which are incorporated herein by reference.

BACKGROUND OF THE INVENTION

1. Field of the Invention

The present invention relates to a shot processing apparatus, and more particularly to shot processing apparatus for shot processing a workpiece by projecting projection material.

2. Description of the Related Art

A drum type shot processing apparatus is known whereby processed parts are placed into a drum and subjected to shot processing while being stirred inside the drum (Patent Document 1).

This drum-type shot processing apparatus comprises a cylindrical drum with a bottom, open at one end, and a centrifugal projector disposed at the opening end of the drum. The projector has a cylindrical control cage with an opening window formed in its outer perimeter wall, from which projection material supplied to the inside is discharged, and blades which rotate outside of this control cage.

When performing shot processing, multiple workpieces are loaded into the drum. As the drum is then rotated about its center axis and workpieces inside the drum are stirred on the bottom portion of the drum, projection material is projected from a projector onto the workpieces in the drum, polishing (cleaning) or otherwise treating the workpieces.

PRIOR ART REFERENCES

Patent Document

Patent Document 1: Japanese Unexamined Patent Publication H08-126959.

SUMMARY OF THE INVENTION

Problems to be Solved by the Invention

However, drums into which workpieces are loaded, constituted as disclosed in Patent Document 1, have some degree of depth so that workpieces do not fly out from the opening during stirring. As a result, the projector disposed on the opening side of the drum and the workpieces being stirred on the bottom portion of the drum are in a separated positional relationship.

Blades placed inside a projector are disposed to extend in the radially outwardly direction from the rotational center of the blade wheel. Projection material discharged first from the control cage opening window therefore contacts the blade at different positions, at essentially the same timing, from projection material discharged later. Portions of projection material which have contacted different positions of the blade at essentially the same time respectively move by the rotation of the blades toward the tip side of the blades as they are accelerated, and are projected from the blade tips at different times.

The timing by which projection material first discharged and projection material later discharged from the control cage opening window are projected from the blade tips therefore differs, and the their respective projection directions differ greatly. Hence for the projector as a whole, projection material is projected in a fan shape (sector form) with a wide opening angle, and the projection range widens with distance from the projector. The fraction of projection material striking workpieces positioned at the bottom portion of the drum, which are separated from the projector, is therefore low, which leads to the problem of long processing times required for polishing, etc., of workpieces.

In light of this problem, the present invention has the object of providing a drum-type shot processing apparatus capable of shortening processing time.

Means for Resolving Problems

The present invention provides a shot processing apparatus comprising: a cylindrical drum opening at one end and having a bottom at the other end; and a centrifugal projector, placed at the opening side of the drum, for projecting projection material onto a workpiece loaded into the drum; wherein the projector comprises: a cylindrical control cage into which projection material is supplied, on the side wall of which an opening window is formed to serve as a discharge opening for the projection material and the opening window has a rectangular shape including two side parallel to the center axis line of the control cage; and a blade wheel comprising multiple blades disposed to extend radially outward of the control cage on the outside of the control cage, rotating about the center axis line of the control cage; whereby a rearward inclining portion inclining to the rotational rearward side, is disposed on the surface of the blades on the forward side in the direction of rotation.

In the invention thus constituted, the control cage opening window is arranged to have a rectangular shape including two sides parallel to the cylinder center axis, and projection material is discharged from the same position in the perimeter direction of the control cage. Projection material discharged outwardly from the opening window contacts the surface of multiple rotating blades outside the control cage and moves toward the tip side of the blades as it is accelerated, then is projected from the blade tips.

An inclined portion inclining to the rotational rearward side relative to the radial direction from the rotational center of the blade wheel, is formed on the surface of the blade wheel blades.

Hence when first-discharged projection material contacts blade surfaces, later-discharged projection material contacts the surface in a position close to the position where the first-discharged projection material contacted the surface, so first-discharged projection material and later-discharged projection material are collected at a close position on the blade surface. Projection material is projected in this collected state, therefore the projection distribution has a fan shape (sector form) with a narrow opening angle.

When the opening angle is narrow, the range over which the projection material strikes is also narrow at positions separated from the projector. That is, the percentage of projection material colliding with workpieces positioned at a distance from the projector inside the drum increases, and wasteful projection is constrained.

According to a preferred embodiment of the present invention, the rearward inclining portion is formed on the rotational direction forward side surface on the radial direction inside part of the control cage; and a non-rearward inclining portion with a smaller inclining angle toward the rotational rearward side than said rearward inclining portion is formed on the tip side of the rearward inclining portion.

By this arrangement, a non-rearward inclining portion is formed on the blade tip portion side, therefore projection material is centrifugally accelerated along the non-rearward inclining portion until immediately before it separates from the blades.

The projection velocity when projection material is projected is the combined velocity from centrifugal acceleration in the direction along the blade surface, and the velocity in a direction tangential to the circle described by the tips of the rotating blades (referred to below simply as the tangent direction). When blades are inclined, the tangential direction component of the velocity in the direction along the blade surface acts in the negative direction relative to the tangential direction. As a result, if the blade rotation outer diameters and rotational circumferential velocities are the same, the combined velocity when the blades are rearward inclining will be lower than the combined velocity when the blades are not rearward inclined.

As described above, up until immediately before projection, in the shot processing apparatus of the present embodiment, the projection material is contacting the non-rearward inclining portion with a small inclining angle toward the rearward side, therefore in the velocity component along the blade surface, the tangential direction component operating in the negative direction relative to the tangential direction velocity is small, and the degree to which the combined velocity is reduced is small. As a result, efficient shot processing can be efficiently accomplished without increasing the blade wheel rpm and by extension the rpm of the motor rotating this blade wheel, and reductions in projection electrical power efficiency can be constrained.

Note that in the present specification, the phrase "a smaller inclining angle toward the rotational rear side than said rearward inclining portion" covers a configuration in which the inclining angle is smaller than the inclining angle to the rotational direction rear side of the rearward inclining portion, and a configuration in which it is inclined to the rotational direction forward side.

In another preferred embodiment of the invention: the radial length of the rearward inclining portion is set to be longer than the radial length of the non-rearward inclining portion.

In this configuration, projection material can be sufficiently gathered at the rearward inclining portion of the blade, and projection material can subsequently be accelerated at the non-rearward inclining portion thereof.

Another preferred embodiment of the invention comprises: a cabinet comprising a infeed/outfeed port through which workpieces are loaded and unloaded, which is closed by an infeed/outfeed door; wherein the projector is attached to the cabinet; and the shot processing apparatus further comprises: a positioning machine for selectively disposing the drum at a workpiece loading position where the workpieces are loaded; a shot processing position at which the drum opening and the projector oppose one another, and a workpiece discharge position at which the workpieces are discharged.

By so doing, the drum itself moves to the workpiece loading position, the shot processing position, and the workpiece discharge position, so no mechanism is required to move the projector.

Another preferred embodiment of the invention comprises: a drum lid for closing off the opening on the drum where the projector is installed; a movement mechanism for selectively disposing the drum lid at the closing position where the drum opening is closed off, and a retracted position not interfering with the workpiece loading means which introduces workpieces through the drum opening into the drum; and a rotating mechanism for selectively disposing the drum at the workpiece introducing and shot processing position where the workpiece is loaded and the drum opening and the projection machine oppose one another, and at the workpiece discharge position where workpieces can be discharged from the drum.

By this constitution, because the drum is selectively disposed at only two locations, i.e., the workpiece introducing and shot processing position, and the workpiece discharge position, the configuration for selectively disposing the drum can be simplified.

The Present invention provides a shot processing apparatus comprising: a cylindrical drum opening at one end and having a bottom at the other end; and a centrifugal projector, placed at the opening side of the drum, for projecting projection material onto a workpiece loaded into the drum; wherein the projector comprises: a cylindrical control cage into which projection material is supplied, on the side wall of which an opening window is formed to serve as a discharge opening for the projection material and the opening window has a rectangular shape including two side parallel to the center axis line of the control cage; and a blade wheel, wherein the blade wheel includes at least one side plate; a plurality of blades attached to the side plate so as to extend radially outwardly of the control cage outside of the control cage; a rotary axis for rotating the side plate and the plurality of blades; and an introducing part for introducing the projection material between the plurality of blades; wherein the blade includes a projection surface for projecting the projection material, and the projection surface has a first part being a radially inner part of the blade and a second part being a radially outer part of the blade; the first part of the blade is formed so as to be inclined such that a radially outer side of the first part is rearwardly positioned in a rotational direction compared to a radially inner side of the first part, and the second part of the blade is formed to be positioned frontwardly of an imaginary line in the rotational direction, which imaginary line is defined by extending the first part of the blade in the radially outward direction, wherein the blade has a blade projection portion on which the projection surface for projecting the projection material is formed, and an attachment portion being formed thicker than the blade projection portion at both edge portions of the blade projection portion and integrally formed with the blade projection portion; wherein the attachment portion is formed in a straight shape at least in a plane perpendicular to the rotary shaft direction of the blade in its outer part and has a locking portion formed such that a plane perpendicular to the direction of the rotary shaft in the radial inner part thereof is formed so as to project from the straight shape; a side plate unit for attaching the plurality of blades thereto; wherein the side plate unit includes a pair of side plates having at least the one side plate, and a connecting member for connecting the pair of side plates; guide channel portions are respectively formed on mutually opposing surfaces of the pair of the side plates in the side plate unit; and the side plate guide channel portions are formed to be inclined such that the radial outer side thereof is positioned rearwardly of the radial inner side thereof in the rotational direction; wherein the side plate unit is attached to the rotary shaft by a bolt, and a recessed portion for attaching the bolt is provided in the guide channel portion of the side plate of the side plate unit.

In another preferred embodiment of the invention, the radial length of the first part is set to be longer than the radial length of the second part.

Another preferred embodiment of the invention comprises a cabinet for housing the drum and comprising a infeed/outfeed port through which workpieces are loaded and unloaded, which is closed by an infeed/outfeed door; wherein the projector is attached to the cabinet; and the shot processing apparatus further comprises a positioning machine for selectively disposing the drum at a workpiece loading position at which the workpieces are loaded; a shot processing position at which the drum opening and the projector oppose one another, and a workpiece discharge position at which the workpieces are discharged.

Another preferred embodiment of the invention further comprises: a drum lid for closing off the opening on the drum where the projector is installed; a movement mechanism for selectively disposing the drum lid at the closing position at which the drum opening is closed off, and a retracted position not interfering with the workpiece loading means which introduces workpieces through the drum opening into the drum; and a rotating mechanism for selectively disposing the drum at the workpiece introducing and shot processing position where the workpiece is loaded and the drum opening and the projection machine oppose one another, and at the workpiece discharge position where workpieces can be discharged from the drum.

Effect of the Invention

The present invention provides a drum-type shot processing apparatus capable of shortening processing time.

BRIEF DESCRIPTION OF THE DRAWINGS

FIG. 9A is a side elevation of a shot processing apparatus in a second embodiment of the invention; FIG. 9B is a side elevation showing the drum opening in FIG. 9A in an open state; FIG. 9C is a side elevation with the drum opening in a closed state; and FIG. 9D is a side elevation showing a state in which workpieces are discharged.

FIG. 13A is a front elevation view of the blade; FIG. 13B is a left side elevation view; FIG. 13C is a rear elevation view; FIG. 13D is a cross sectional view seen along line S1-S1 in FIG. 13A; FIG. 13E is a plan view (top view); and FIG. 13F is a bottom view (underside view).

FIGS. 14A through 14D are perspective views from respectively different directions.

FIG. 15A is a front elevation cross sectional view showing a side plate unit with the blade attached; FIG. 15B is an enlarged view showing the portion of dotted line B1; and FIG. 15C is a rear elevation view of the side plate unit with the blade attached.

FIG. 16A is a front elevation cross sectional view showing the side plate unit; and FIG. 16B is a cross sectional view seen along line S2-S2 shown in FIG. 16A.

FIG. 18A is a cross sectional view showing a rotationally driven blade, a side plate unit, and a distributor; FIG. 18B is a cross sectional view of a liner; FIG. 18C is a cross sectional view of a lid; and FIG. 18D is a cross sectional view of a main unit case.

FIGS. 19A-19N are diagrams for explaining the advantages of pitching the first part of the blade rearward. FIGS. 19A through 19G are diagrams showing the behavior of projection material resulting from the rearward pitching blade according to the present invention; and FIGS. 19H through 19N are diagrams showing the behavior of a conventional forward-pitched blade for comparison thereto.

FIG. 20A is a front elevational view of the blade; FIG. 20B is a left side elevational view; FIG. 20C is a rear elevational view; FIG. 20D is a cross sectional view seen along line S3-S3 shown in FIG. 20A; FIG. 20E is a plan view (top view); FIG. 20F is a bottom view (underside view).

FIGS. 21A through 21D are perspective views from respectively different directions.

FIGS. 22A-22N are diagrams showing another example of a blade which can be used in a centrifugal projector according to an embodiment of the invention. FIG. 22A is a side elevational view of a control cage with an opening window; FIG. 22B is a side elevational view of a control cage with two opening windows; FIG. 22C is a side elevational view of a control cage with one opening window in which portions of two rectangles are overlapped and integrated; FIG. 22D is a side elevational view of a control cage with a parallelogram opening window; FIGS. 22E and 22F are side elevational views of a control cage with a single opening window in which parts of three or more squares are overlapped and integrated; and FIGS. 22G through 22N are diagrams showing the projection distribution, etc. of each control cage.

DETAILED DESCRIPTION OF THE PREFERRED EMBODIMENTS

First Embodiment

Below, referring to FIGS. 1 through 6, a shot processing apparatus 10 of a first embodiment of the invention will be explained.

Figure 1:
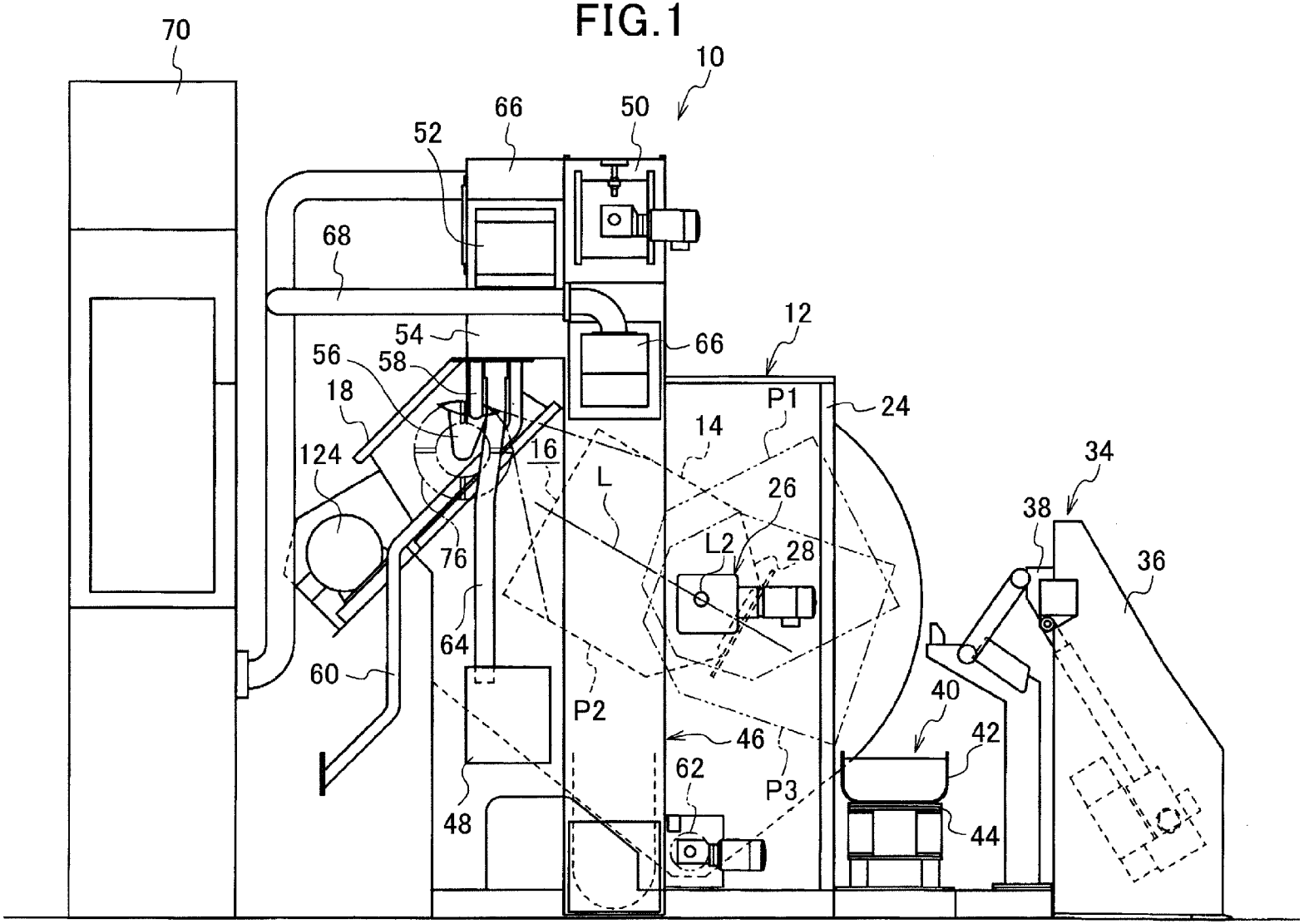
FIG. 1 is a side elevation showing a shot processing apparatus in a first embodiment of the invention.

As shown in FIG. 1, the shot processing apparatus 10 comprises a cabinet 12, a drum 14 housed inside the cabinet 12, and a projector 18.

The cabinet 12 has a side wall portion 24 on which an infeed/outfeed port 22 for inserting and removing workpieces (see FIG. 3) is formed. The infeed/outfeed port 22 is closed off by an infeed/outfeed door 20 separate from the cabinet (see FIG. 4). The structure of the cabinet 12 comprises a structure in which all sides of the internal space are surrounded by walls resulting in a closed state whereby projection material is not scattered to the outside when being projected.

The projector 18 is attached to the cabinet 12, that is to say to one of the parts of the cabinet 12 other than the part of cabinet 12 where the infeed/outfeed door 20, is placed.

The drum 14 has a substantially cylindrical shape with a bottom, with an opening 16 at one end enabling workpieces to be loaded, and closed on the other end by a drum bottom 28. This drum 14 can be rotated about a cylinder axial center L by a drive motor 30 (see FIG. 4). The drum 14 is also rotated by a rotary mechanism 26 about a rotation axis L2 extending in the horizontal direction perpendicular to cylinder axial center L. By this arrangement, the drum 14 can be disposed at optimal rotational direction positions in the respective steps occurring when workpieces are loaded into the cabinet 12, at time of shot processing, and at time of workpiece discharge.

In addition, the drum 14 has multiple through holes (not shown). The size of these through holes is set to allow the passage of projection material but not the passage of workpieces. Projection material projected inside the drum 14 passes through the through holes and is discharged outside the drum 14.

A workpiece loading means 34 for introducing workpieces into the drum 14 is disposed behind the side wall portion 24 of the cabinet 12 in the shot processing apparatus 10. The workpiece loading means 34 comprises: a box-shaped loading bucket 36 for containing workpieces loaded into the drum 14; and a bucket loader 38 for tilting the loading bucket 36 so that the loading bucket 36 can be raised to the infeed/outfeed port 22 to enable contained workpieces to be loaded into the drum 14 from above the infeed/outfeed port 22.

A workpiece discharge means 40 is disposed between the cabinet 12 side wall portion 24 and the workpiece loading means 34. The workpiece discharge means 40 comprises a workpiece receiving trough 42 and an outfeed vibrating feeder 44. The workpiece receiving trough 42 is a container for receiving shot-processed workpieces discharged through the infeed/outfeed 22 from inside the drum 14, which is rotated to the workpiece discharge position P3 when workpieces are discharged after shot processing is completed. The outfeed vibrating feeder 44 is an apparatus for outfeeding workpieces inside the workpiece receiving trough 42 to a location outside the shot processing apparatus 10.

A circulating apparatus 46 is disposed at a position on the opposite side of the side wall portion 24 inside the cabinet 12. The circulating apparatus 46 has: a projection material supply box 48 into which projection material is loaded; a bucket elevator 50 to which a bucket (not shown) is attached for lifting projection material up from the projection material supply box 48; a separator 52 connected to an upper discharge port on the bucket elevator 50; a hopper 54 mounted below the separator 52; a projection material loading pipe 58 connecting the hopper 54 and an introduction tube 56 attached to the projector 18; and a scale discharge pipe 60 extending outside the shot processing apparatus 10 from the hopper 54.

Figure 2:
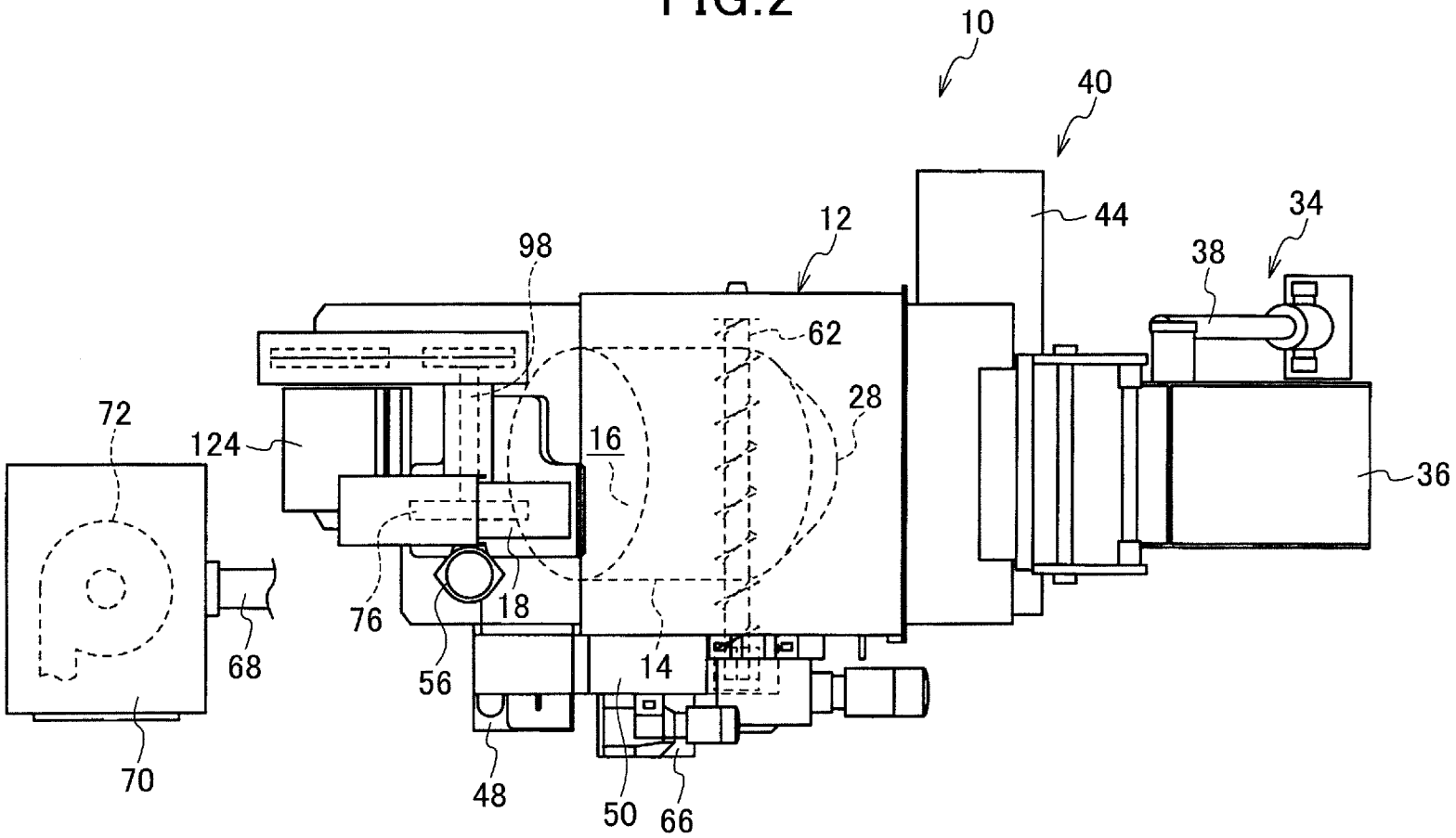
FIG. 2 is a plan view showing a shot processing apparatus in a first embodiment of the invention.
Figure 3:
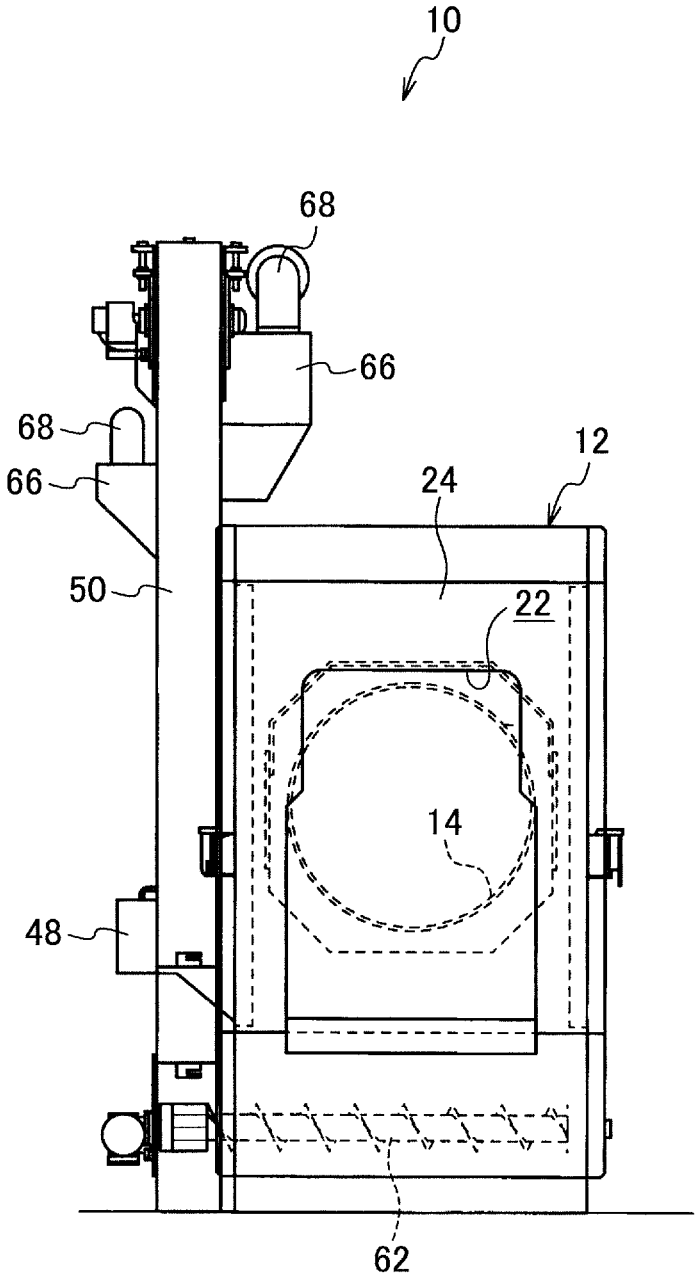
FIG. 3 is a front elevation showing a shot processing apparatus in a first embodiment of the invention.

A screw conveyor 62 for recovering projection material to the bucket elevator 50 side is mounted on the lower portion of the cabinet 12 (see FIG. 2). In addition, a projection material overflow pipe 64 connecting the hopper 54 and the projection material supply box 48 is disposed at the bottom portion of the hopper 54.

The bucket elevator 50 and the separator 52 are connected to a dust collection apparatus 70 through a duct 68 connected to a duct connecting portion 66. This dust collection apparatus 70 comprises a suction fan 72 (see FIG. 2); light dust and the like which do not collect at the bottom portion of the cabinet 12 are suctioned and discharged by the suction fan 72.

Figure 5:
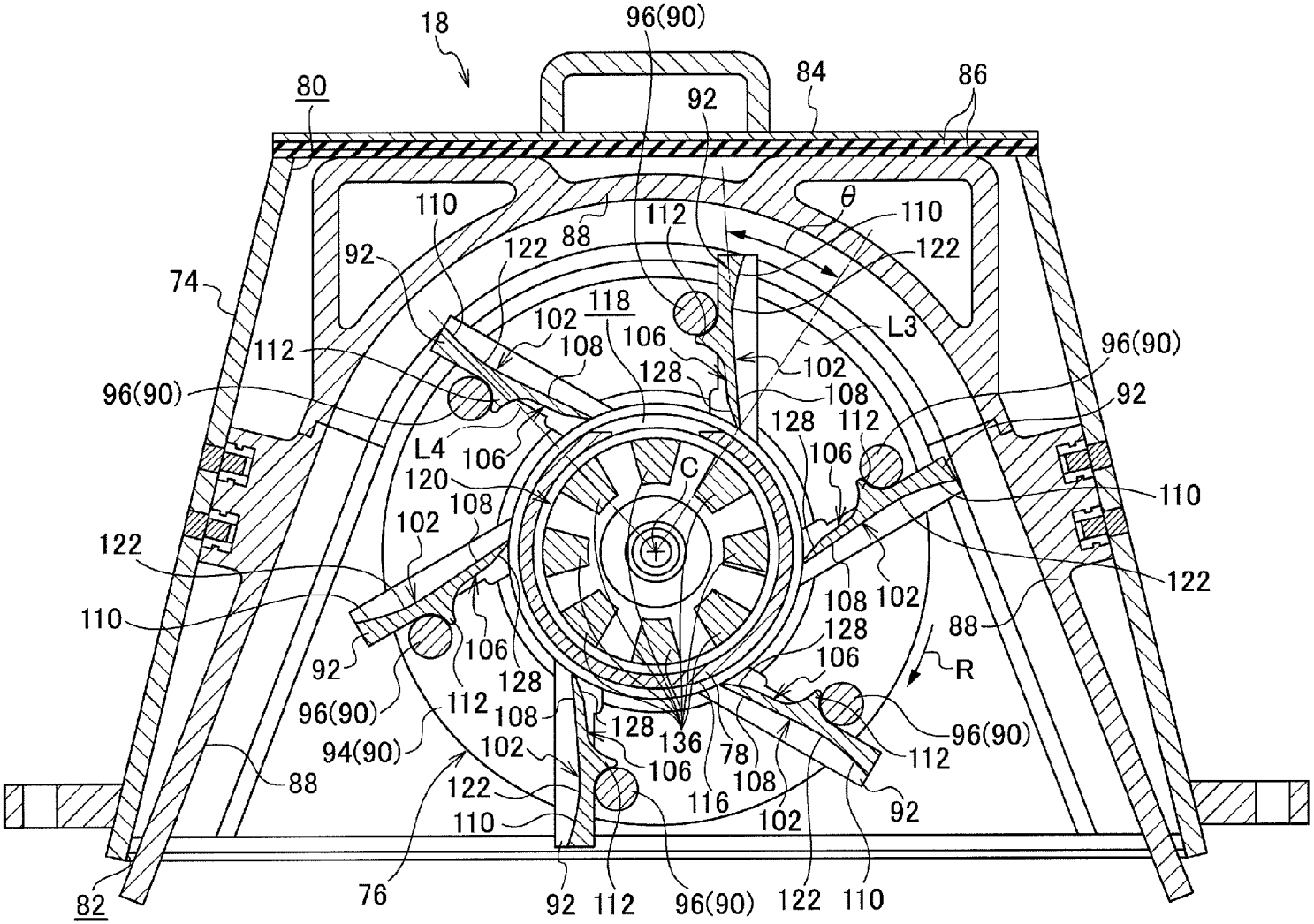
FIG. 5 is a cross section showing a projector in a shot processing apparatus in a first embodiment of the invention.

As shown in FIG. 5, the projector 18 comprises: a main unit case 74 with a trapezoidal external shape as seen from the side, a blade wheel 76 contained inside the main unit case 74 and capable of rotation, and a control cage 78 disposed on the inside perimeter side of the blade wheel 76; this is what is known as a centrifugal projector, which projects projection material using centrifugal force.

The main unit case 74 is formed in a square pipe shape, in which the top side end portion 80 and bottom side end portion 82 are open; a case lid 84 is attached to the top side end portion 80 so as to close off the opening on the top side end portion 80 via a seal material 86. Note that a liner 88 for protecting the main unit case 74 and the case lid 84 is attached between the main unit case 74 and case lid 84, and the blade wheel 76. The main unit case 74 is attached to the cabinet 12 so that the opening on the bottom side end portion 82 faces the interior of the cabinet 12 (see FIG. 1).

The blade wheel 76 comprises a side plate unit 90 and multiple blades 92 disposed at intervals in the circumferential direction of the side plate unit 90. The side plate unit 90 comprises two annular side plates 94 disposed at intervals in mutual opposition, and multiple round columnar connecting members 96 disposed at intervals in the circumferential direction so as to link the oppositely disposed side plates 94.

The blade wheel 76 is connected to a rotary shaft 98 (see FIG. 2). The rotary shaft 98 is driven by a belt (not shown) connected to a drive motor 124.

A rearward inclining portion 108 inclining to the rear side in the rotational direction (direction of arrow R) relative to the radial direction of the blade wheel 76 (see radial direction line L3) is formed on the surface 102 facing in the rotational forward direction of the blades 92. The rearward inclining portion 108 is formed on the base end side (radial direction inner side) of the blades 92, and preferably inclines 30° to 50° to the rear side in the rotational direction (arrow R direction) relative to the radial direction of blade wheel 76

(see radial direction line L3). In the present embodiment, it inclines 40° to the rear side. That is, in FIG. 5, θ=40°.

In contrast, a non-rearward inclining portion 110 extending in the radial direction (see radial direction line L4) from the rotational center C of the blade wheel 76 is formed on the tip side (radial direction outer side) part of the blades 92 surface 102. That is, the non-rearward inclining portion 110 is arranged so that its inclining angle is less toward the rotation direction rear side than toward the rearward inclining portion.

The radial length of the blade wheel 76 rearward inclining portion 108 is set to be longer than the radial length of the non-rearward inclining portion 110. A curved portion 122 is formed on the surface 102 of the blades 92 to smoothly connect the rearward inclining portion 108 and the non-rearward inclining portion 110.

On the reverse surface 106, which is on the opposite side in the rotational direction to the surface 102 of the blades 92, a inclining portion 128 is formed on the base end portion (radial direction inside portion), which inclines more to the rotational rear side than the rearward inclining portion 108 relative to the radial direction. Projecting portions 112 are formed to project out at midway portion in the longitudinal direction on the reverse surface 106 of the blades 92. On these projecting portions 112, an indented curved portion on the radial outer side of the blade wheel 76 contacts the connecting members 96.

Figure 6:
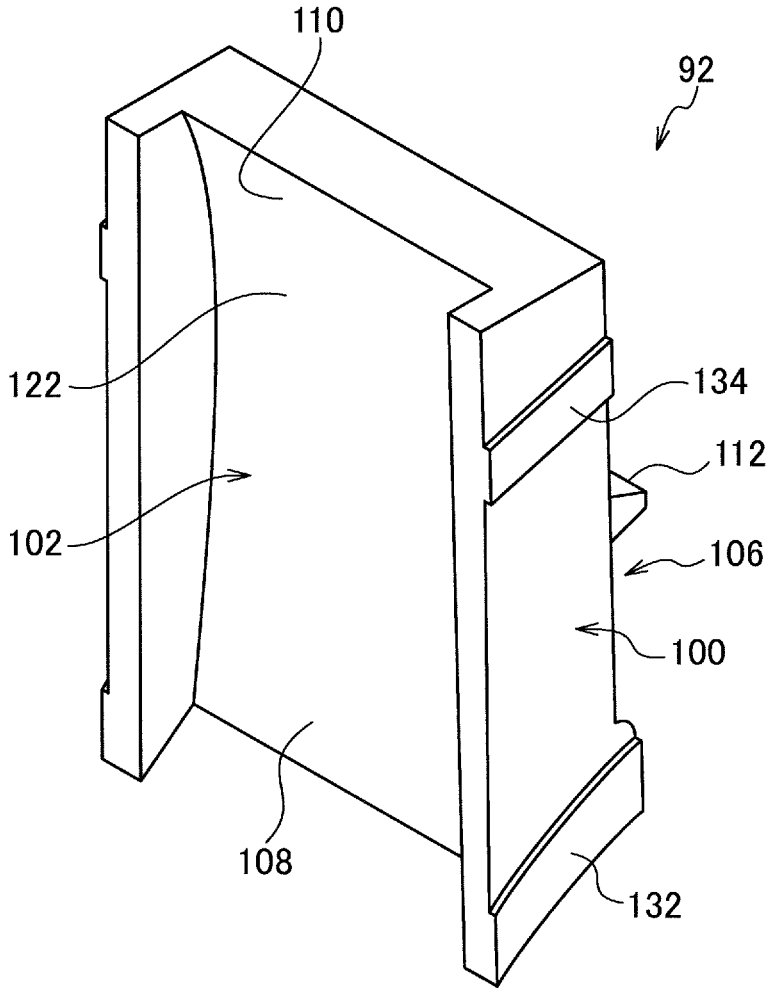
FIG. 6 is a perspective view of blades in the FIG. 5 projector.

As shown in FIG. 6, side wall portions 100 extending from the surface 102 in the thickness direction of the blades 92 are formed on both side portions of the blade 92 surfaces 102. A base end-side raised portion 132 projecting outward in the width direction of the blades 92 is formed on the base end side of the side wall portions 100; a top end-side raised portion 134 projecting outward in the width direction of the blades 92 is formed on the tip end side of the side wall portions 100. The base end raised portion 132 and the top end-side raised portion 134 incline slightly on the base end side (bottom side in the figure) from the reverse surface 106 side toward the surface 102 side.

The side wall portions 100 are treated as sites on the blades 92 fitted into the channel portion of the side plates 94 shown in FIG. 5. The base end raised portion 132 and the top end-side raised portion 134 on the side wall portions 100 shown in FIG. 6 become sites which contact the channel bottom surface of the side panels 94 shown in FIG. 5.

The control cage 78 has cylindrical shape. An introduction tube 56 (see FIGS. 1 and 2) is connected to one end of the control cage 78 in the axial direction. By this means, projection material is supplied into the control cage 78 from the introduction tube 56.

Figure 7:
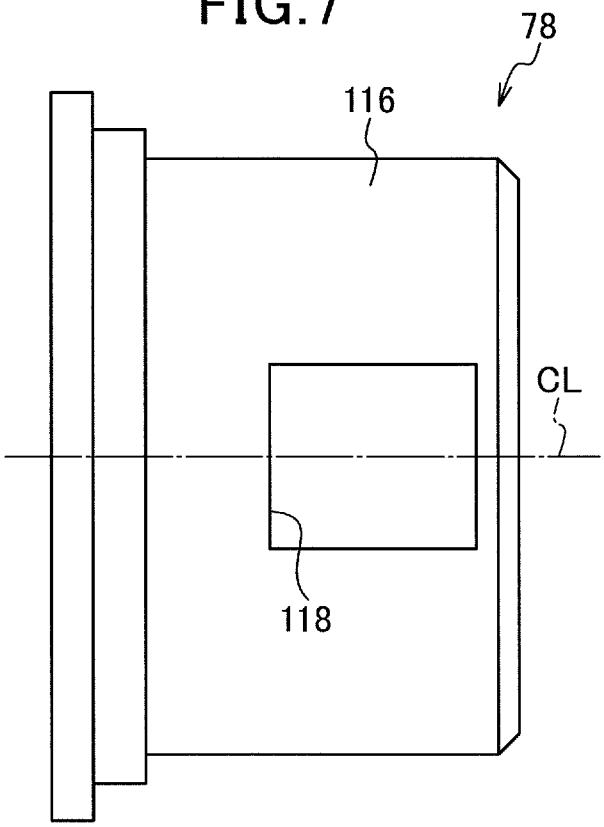
FIG. 7 is a side elevation of the control cage in the FIG. 5 projector.

An opening window 118 serving as a projection material discharge portion is formed on a part of the side facing the top side end portion 80 of the main unit case 74 on the outer perimeter wall 116 of the control cage 78, and passes through the outer perimeter wall 116 (see FIG. 7).

This opening window 118 is formed in a rectangular shape which includes two sides parallel to the cylindrical axial center CL of the control cage 78. The control cage 78 is fixed so as not to rotate relative to the main unit case 74.

As shown in FIG. 5, a distributor 120 is disposed on the inner side of the control cage 78. The distributor 120 comprises multiple vanes 136 extending in the inward radial direction, and multiple openings at equal spacing in the circumferential direction, and is disposed on the inside of the control cage 78 so as to form a gap relative to the control cage 78.

The distributor 120 is rotated on the inside of the control cage 78 by a rotary shaft 98 (see FIG. 2).

Projection material supplied to the control cage 78 by rotation of the distributor 120 is blended inside the distributor 120 and supplied by centrifugal force from the distributor 120 opening, through the distributor 120, and into the gap between the distributor 120 and the control cage 78.

Projection material supplied to this gap moves in the rotational direction within this gap along the inside perimeter surface of the control cage 78, and is discharged in the radial outwardly direction from the control cage 78 opening window 118.

At this point, the direction of projection material discharged from the opening window 118 in the control cage 78 inclines from the rotational center of the distributor 120 toward the rotational direction (arrow R direction) of the blade wheel 76 relative to the radial direction.

Next, the operation of the above-described shot processing apparatus 10 will be explained.

When a workpiece is loaded into the drum 14, the infeed/outfeed door 20 which closes off the infeed/outfeed 22 is opened and, as shown in FIG. 1, the drum 14 is rotated about rotation axis L2 to a workpiece loading position P1 so that the opening 16 faces the infeed/outfeed 22. In this state, workpieces fed from outside the shot processing apparatus 10 by the workpiece loading means 34 are loaded into the drum 14.

When the loading of workpieces into the drum 14 is completed, the drum 14 is rotated about rotation axis L2 to a shot processing position P2. In addition, the infeed/outfeed door 20 is closed off and the cabinet 12 placed in a closed state. When the drum 14 is disposed at the shot processing position P2, the drum 14 is rotated about cylinder axial center L, stirring the workpieces in the drum 14.

The projector 18, the bucket elevator 50, the screw conveyor 62, and the dust collection apparatus 70 are operated while the drum 14 is rotated about the cylinder axial center L. By this means, projection material is loaded from the bucket elevator 50 through the separator 52 and the hopper 54, through the projection material loading pipe 58 and the introduction tube 56, and into the projector 18. Specifically, projection material passing through the interior of the introduction tube 56 is directed to the projector 18 distributor 120. Because the distributor 120 is rotated by a drive force from the drive motor 124, the projection material moves toward the outer perimeter side of the distributor 120 by centrifugal force, and flows along the inside perimeter surface of the control cage 78.

Projection material flowing along the inside perimeter surface of the control cage 78 is discharged from the opening window 118 on the control cage 78 in a direction inclining to the rotational direction (arrow R direction) of the blade wheel 76 relative to the radial direction. Discharged projection material contacts the rearward inclining portion 108 on the surface 102 of the blades 92 on the blade wheel 76 rotating on the outside of the control cage 78, and is sent to the non-rearward inclining portion 110 by centrifugal force as it is accelerated. The projection material then separates from the tips of the blades 92 and is projected from the bottom side end portion 82 of the main unit case 74 toward the workpieces in the drum 14 and collides with the workpieces.

The projection material colliding with workpieces in the drum 14 is discharged from the drum 14 by the rotation of the drum 14 through holes together with dust, scale, and the like produced during shot processing. Discharged projection material and the like are gathered in the lower portion of the bucket elevator 50 by a screw conveyor 62 at the bottom portion of the cabinet 12. It is then carried to the separator 52 by the bucket elevator 50, and in the separator 52 is separated into reusable projection material and dust or scale, etc.

Separated reusable projection material is accumulated in the hopper 54 and is supplied to the projector 18 through the projection material loading pipe 58 for reuse. Projection material which exceeds the holding capacity of the hopper 54 is fed through the projection material overflow pipe 64, which is connected to the lower portion of the hopper 54 and extends to the projection material supply box 48. On the other hand, dust, scale, and the like are discharged through the scale discharge pipe 60 to outside the shot processing apparatus 10. Light weight dust and the like which does not collect at the lower portion of the cabinet 12 can be suctioned in and discharged by a dust collection apparatus 70.

When shot processing ends, the projector 18 is stopped, the drum 14 is rotated about the rotation axis L2 to a workpiece discharge position P3, and the infeed/outfeed 22 on the cabinet 12 is released. Workpieces in the drum 14 are in this way moved to the workpiece receiving trough 42 on the workpiece discharge means 40, then fed to outside the shot processing apparatus 10 by the outfeed vibrating feeder 44, completing an operation sequence.

First Embodiment Action and Effect

Figure 10:
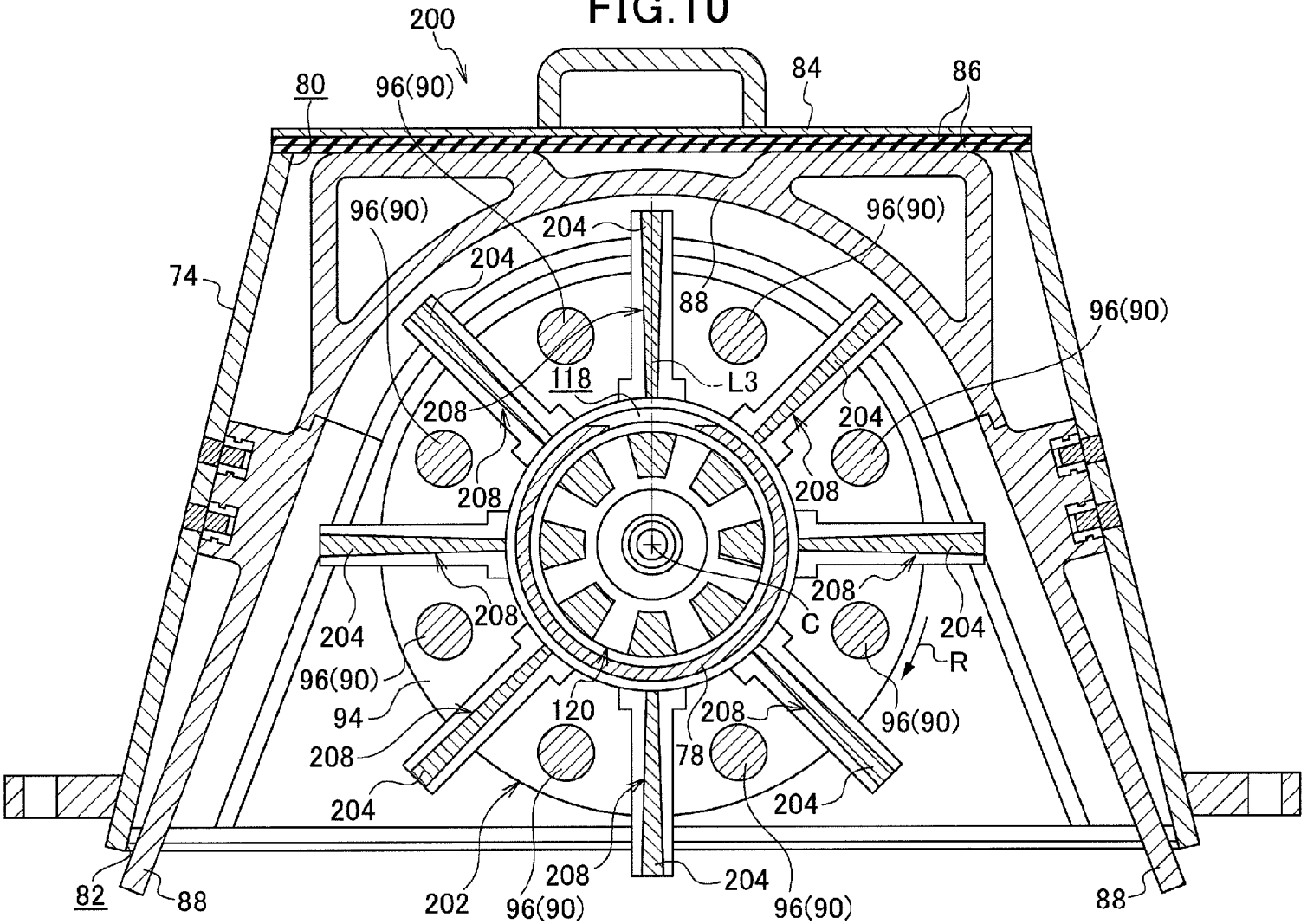
FIG. 10 is a cross section of the projector in a shot processing apparatus according to a comparative example.
Figure 11:
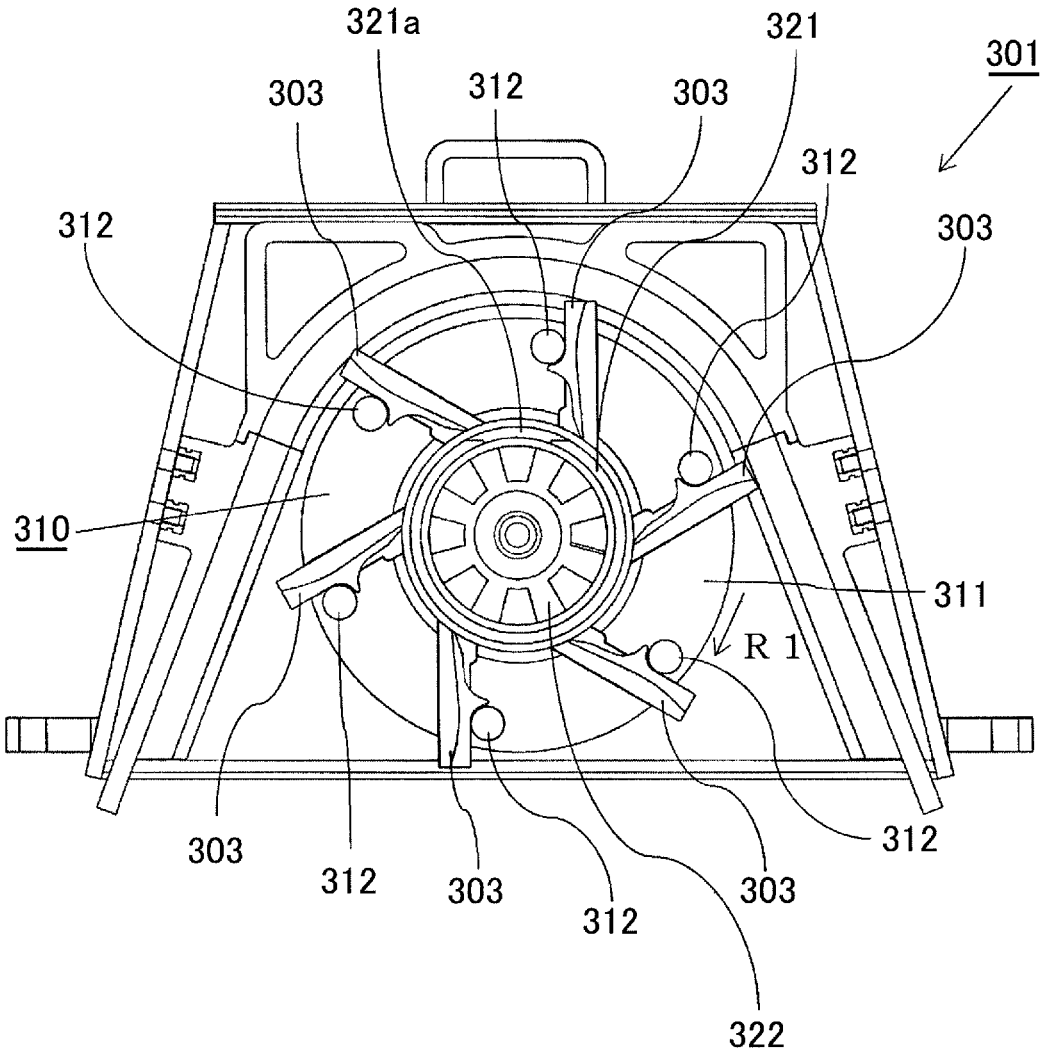
FIG. 11 is a front elevation cross sectional view showing a centrifugal projector alternatively used in an embodiment of the present invention.
Figure 12:
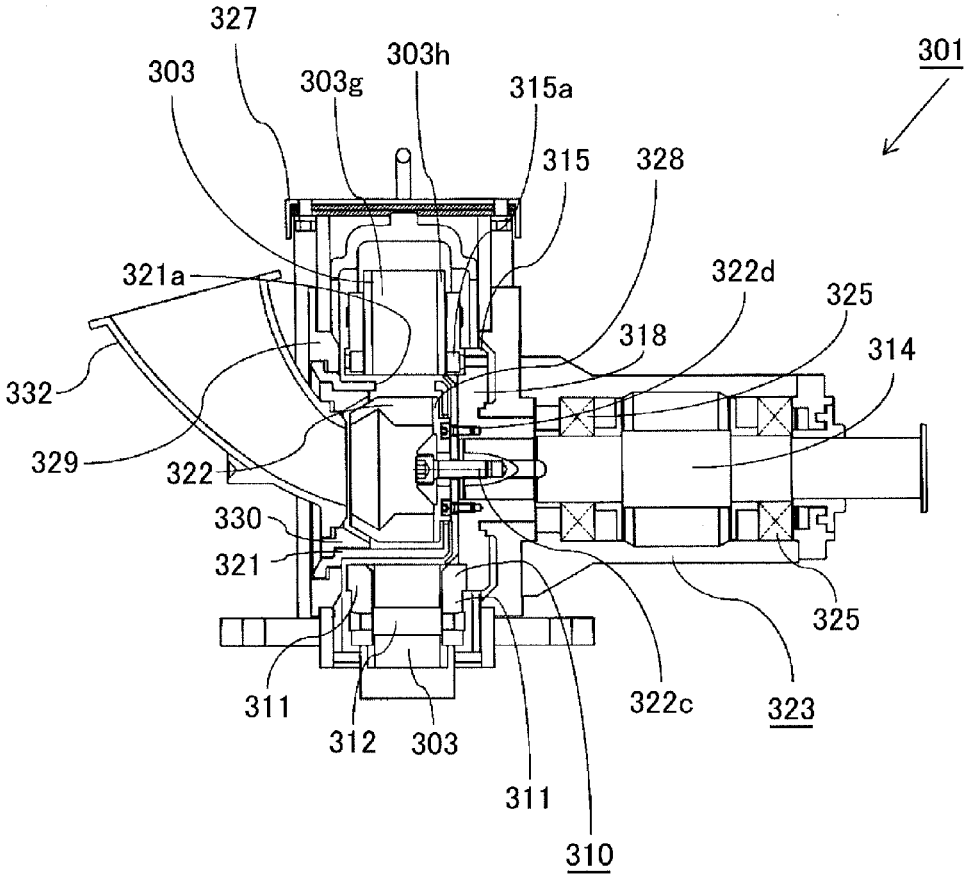
FIG. 12 is a side elevation cross sectional view of the centrifugal projector shown in FIG. 11.
Figures 13A, 13B, 13C, 13D, 13E, 13F:
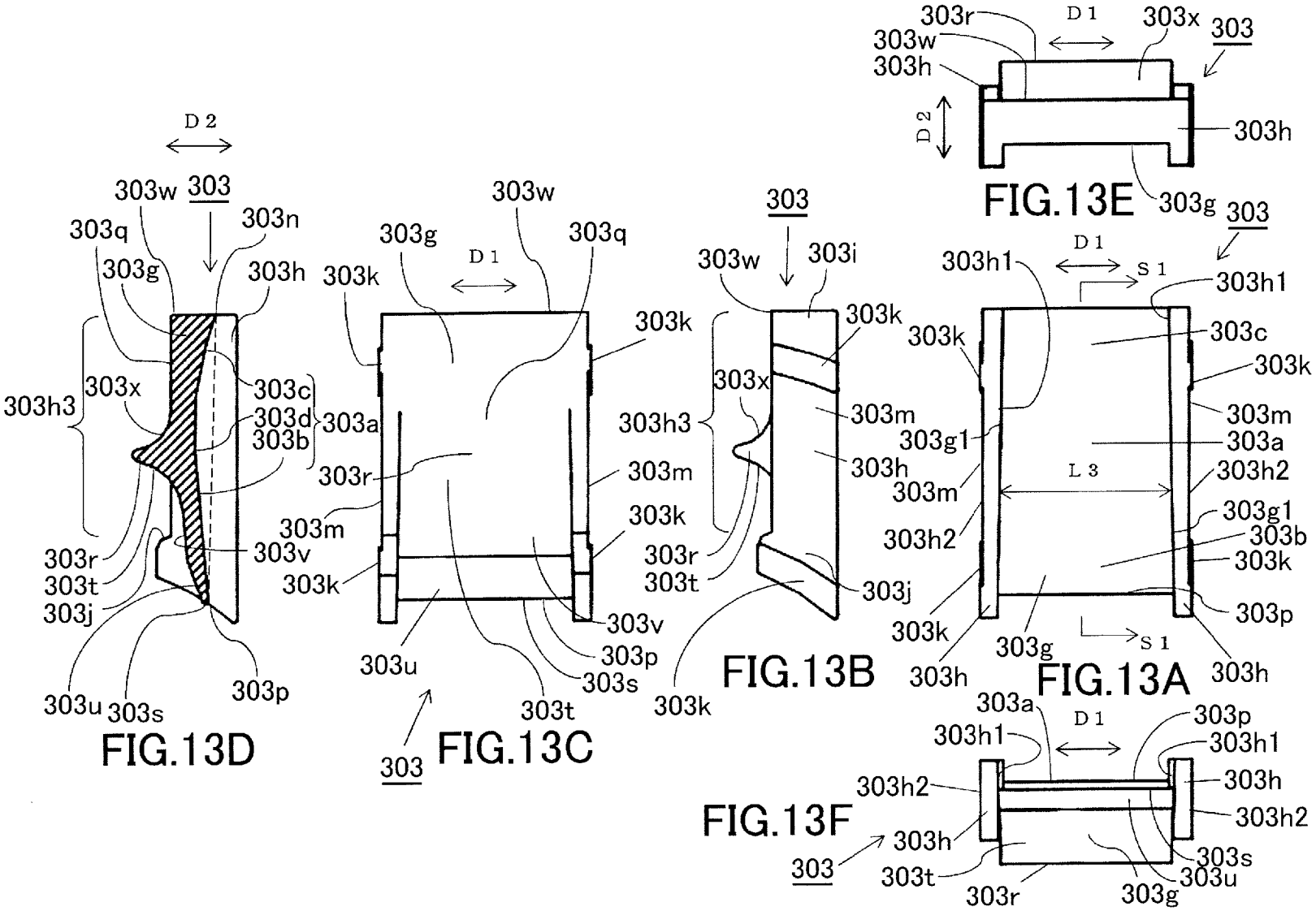
FIGS. 13A-13F are diagrams showing a blade in the centrifugal projector shown in FIG. 11.
Figure 14A:
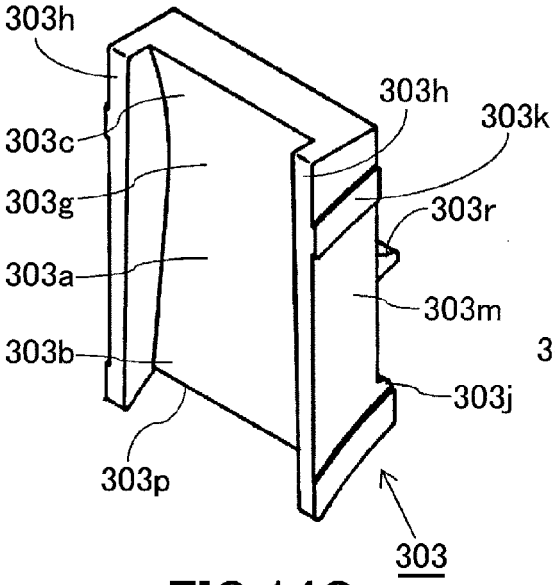
FIGS. 14A-14D are perspective views showing the blade shown in FIGS. 13A-13F.
Figure 14B:
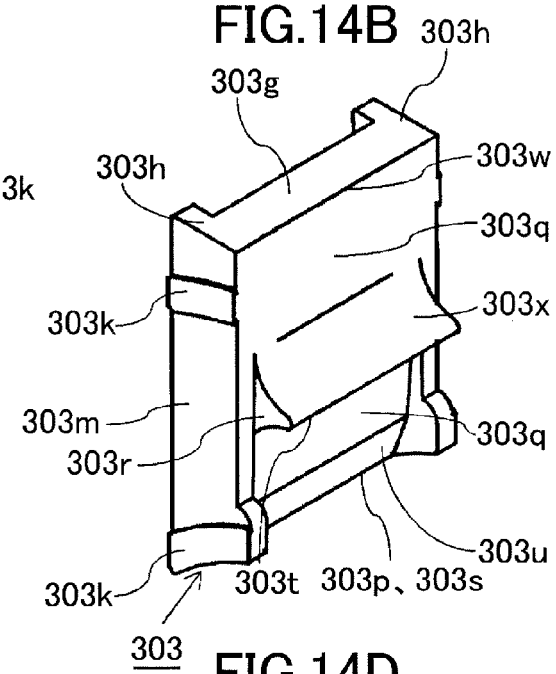
Figure 14C:
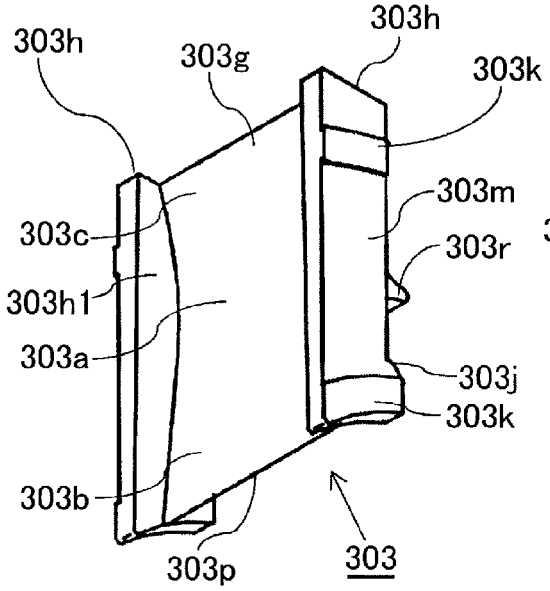
Figure 14D:
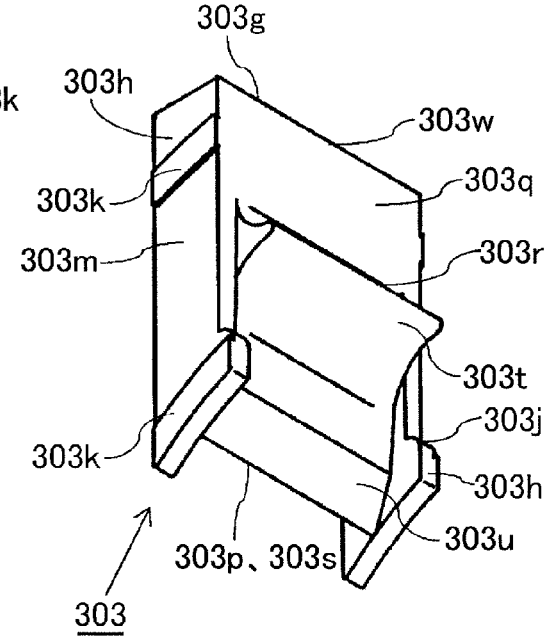

Next, referring to the comparative example shown in FIG. 10, their action and effect on the shot processing apparatus of the present embodiment will be explained. Note that in the comparative example those constituent parts which are the same as the present embodiment are assigned the same reference numerals, and an explanation thereof is omitted.

In the projector 200 of the comparative example shown in FIG. 10, the surface of the blade wheel 202 blades 204 extends in the radial direction (see radial direction line L3), therefore projection material discharged first and projection material discharged later from the opening window 118 in the control cage 78 contacts the blade at different positions in the radial direction at approximately the same time, and is respectively accelerated in the tip direction and separates from the blade tips, so that projection material is projected.

Therefore the timing at which projection material is projected from the tips of the blades 204 differs between first discharged projection material and later discharged projection material, and the projection directions of each of the respective units of projection material differ. As a result, projection material is projected from the projector 200 in a fan shape with a wide opening angle, and the range of projection material contact widens with distance from the projector 200.

Figure 4:
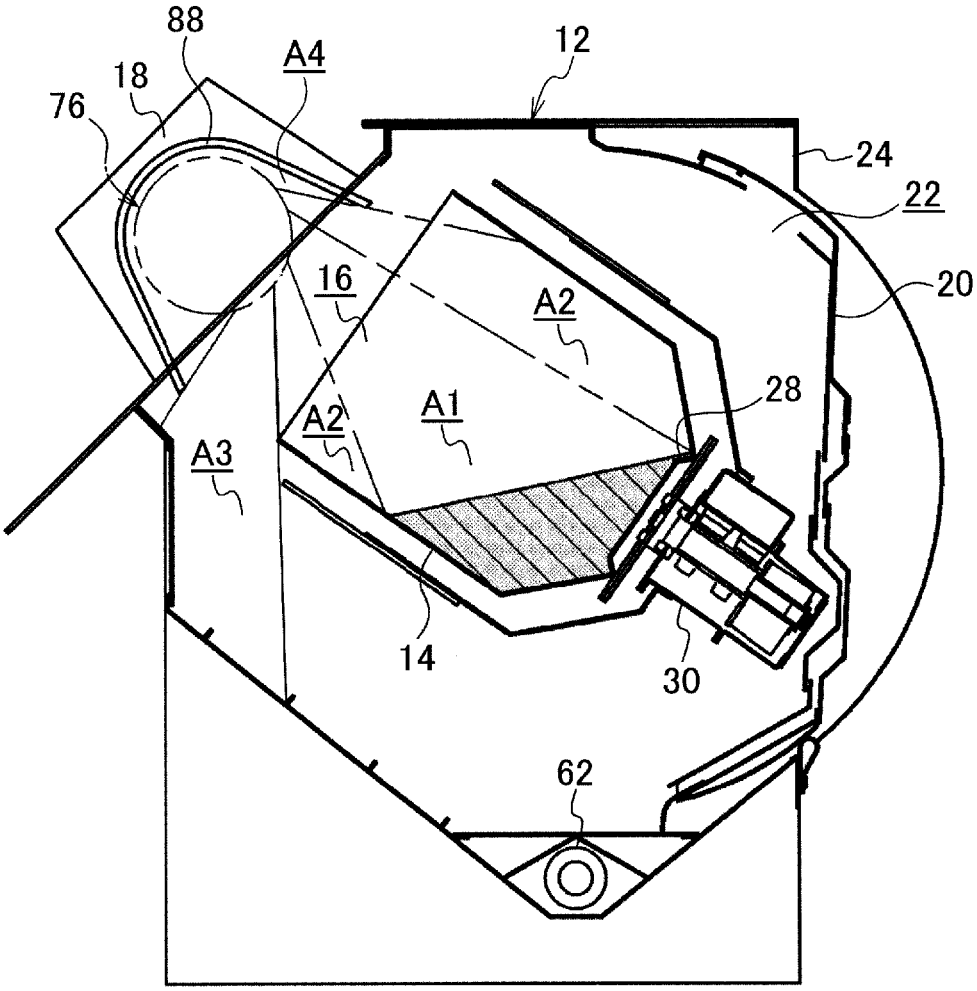
FIG. 4 is an enlarged cross section schematically showing the projection range of a projector in a first embodiment shot processing apparatus of the present invention.

That is, as shown in FIG. 4, projection material projected from the projector 200 reaches not only an effective projection range A1 corresponding to the bottom portion of the drum 14, but also a drum inside wall projection range A2, being the range of direct projection on the inside wall of the drum 14, and a cabinet projection range A3, being the direct projection range on the inside surface of the cabinet 12, and a blade wheel inside projection range A4, being the range of direct projection onto the liner 88 of the projector 200.

Figure 8B:
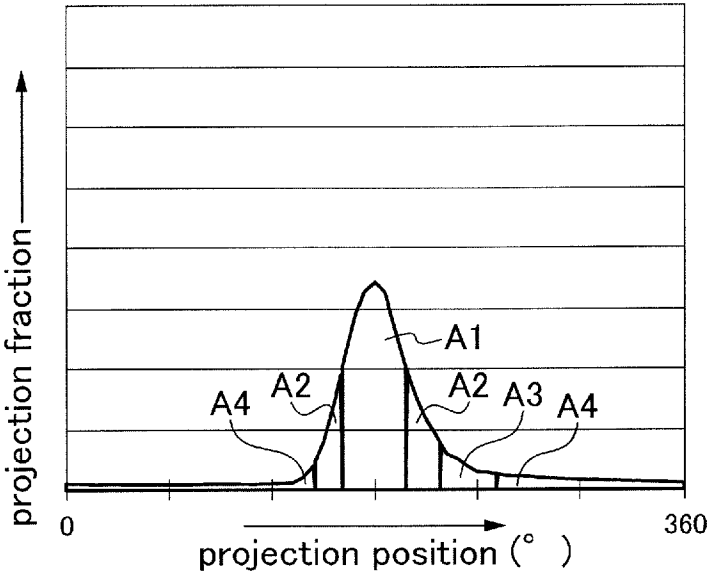
FIG. 8B a projection distribution diagram showing the relationship between the projection fraction and the projection position in a comparative example shot processing apparatus.

Therefore, as shown in projection distribution chart of the FIG. 8B, the fraction of projection material projected to the effective projection range A1 decreases, and the fraction of projection material projected to the drum inside wall projection range A2, the cabinet projection range A3, and the blade wheel inside projection range A4 increases. Hence the processing time needed to polish workpieces lengthens, and wear of the drum 14 and cabinet 12, etc., struck by the projection material is promoted.

In the shot processing apparatus of the present embodiment, as shown in FIG. 7, the opening window 118 of the control cage 78 is given a rectangular shape including two sides parallel to the cylinder axial center CL, therefore projection material is discharged from the same position in the perimeter direction of the control cage 78.

Projection material discharged to the outside from the opening window 118 contacts the surface 102 of the multiple blades 92 rotating in the circumferential direction of the control cage 78, moving toward the tip side of the blades 92 while being accelerated, and is projected from the blades 92 tips.

In the shot processing apparatus of the present embodiment, a rearward inclining portion 108 inclining to the rotational rear side relative to the radial direction is formed on the surface 102 of the blades 92 of the blade wheel 76.

Projection material discharged later from the opening window 118 of the control cage 78 therefore contacts the surface 102 of the blades 92 before the projection material discharged later from the control cage 78 opening window 118 contacts the surface 102 of the blades 92, and is moved toward the tip side of the blades 92 as it is accelerated.

In the shot processing apparatus of the present embodiment, first discharged projection material contacts the surface 102 at a position close to the position where later discharged projection material, which has already moved along the surface of the blades 92, is present, therefore first discharged projection material and later discharged projection material are gathered at a close by position on the surface 102 of the blades 92.

The projection material separates and is projected from the blades in a collected state, therefore projection distribution can be concentrated. That is, the distribution of projection material projected from the projector 18 forms a fan shape with a narrow opening angle.

Figure 8A:
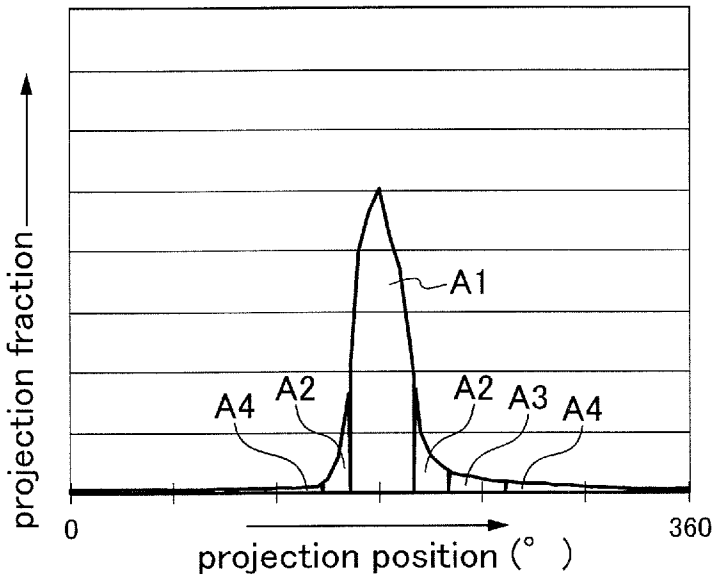
FIG. 8A is a projection distribution diagram showing the relationship between the projection fraction and projection position in the FIG. 1 shot processing apparatus.

When the opening angle is narrow in this way, the range over which the projection material strikes is also narrow even at a distance from the projector. Therefore in the effective projection range A1 of projection material projected onto workpieces (see FIG. 4), the projection material projection fraction increases, as shown in the FIG. 8A projection distribution chart. In the drum inside wall projection range A2, cabinet projection range A3, and blade wheel inside projection range A4 (see FIG. 4), which are ranges outside the effective projection range A1, the projection material projection fraction decreases. That is, wasteful projection to locations other than workpieces can be constrained, and the fraction of projection material projected toward workpieces can be increased. Processing time can thus be shortened.

The fraction of projection material projected onto locations other than workpieces, i.e., onto the drum 14, the cabinet 12, etc., declines, so wear of the inside surface of the drum 14 and the cabinet 12 can be restrained, and the frequency of maintenance can be reduced.

In addition, the total projected amount of projection material declines, so the total amount of projection material circulating in the shot processing apparatus 10 decreases, allowing the circulating apparatus 46 for circulating the projection material to be made compact.

In the shot processing apparatus of the present embodiment, a non-rearward inclining portion 110 is formed on the tip portion of the blades 92, therefore projection material can separate from the non-rearward inclining portion 110 when projected from the blades 92.

The projection velocity, when projection material is projected, is the combined velocity of velocity in a direction along the surface of the blade from centrifugal acceleration in the direction along the blade surface, and the velocity in a direction tangential to the circle described by the tips of the rotating blades (referred to below simply as the tangent direction). When the blade rotation outside diameter and rotation circumferential velocity are the same, the combined velocity will decline when the blade is inclined rearward, because the tangential direction component of the velocity in the direction along the blade surface acts in the opposite direction relative to the velocity in the tangential direction. That is, the combined velocity when the blades are inclining rearward is lower than the combined velocity when the blades are not inclining rearward.

As described above, in the shot processing apparatus of the present embodiment the projection material contacts the non-rearward inclining portion 110 extending in the radial direction until immediately before projection, therefore the velocity in the direction along the surface 102 of the blades 92 caused by centrifugal acceleration at time of projection has only a radial component, and does not have a component which acts in the negative direction relative to the velocity in the tangential direction. The velocity in the direction along the blade surface due to centrifugal acceleration therefore does not reduce the combined velocity. As a result, the rpm of the blade wheel 76, i.e., the rpm of the motor rotating this blade wheel, is not increased, and efficient shot processing can be accomplished, while reductions in projection electrical power efficiency can be constrained.

In addition, the radial length of the blade wheel 76 rearward inclining portion 108 is set to be longer than the length of the non-rearward inclining portion 110, therefore projection material can be sufficiently collected by the blade 92 rearward inclining portion 108. As a result, processing time can be even more significantly shortened.

Moreover, the drum 14 itself can be moved to the workpiece loading position P1, the shot processing position P2, or the workpiece discharge position P3, making it unnecessary to move the projector 18.

The projector 18 is disposed at a location other than the location where the cabinet 12 infeed/outfeed door 20 is disposed, therefore the drum 14 alone can be moved to workpiece loading position P1, shot processing position P2, and workpiece discharge position P3, and shot processing performed without moving the projector 18. A moving mechanism for the projector 18 is therefore unnecessary, and the shot processing apparatus 10 can be reduced in size.

Second Embodiment

Next, referring to FIGS. 9A-9D, a shot processing apparatus 140 in a second embodiment of the invention will be explained. Note that the same reference numerals are assigned for those constituent parts which are the same as the first embodiment shot processing apparatus, and an explanation thereof is omitted.

The second embodiment shot processing apparatus 140 is basically the same as the first embodiment, but as shown in FIG. 9A, the drum 14 differs from the first embodiment shot processing apparatus in that it comprises a drum lid 142 for closing off the opening 16, and in that the projector 18 is attached to this drum lid 142.

Using a shot processing apparatus 140, the drum 14 is rotated by a rotary mechanism 26 (see FIG. 1) about the rotation axis L2, perpendicular to cylinder axial center L and extending in a horizontal direction, and is selectively disposed at a position suitable for workpiece loading, shot processing, and workpiece discharge.

As shown in FIG. 9B, when loading workpieces into the drum 14, the drum lid 142 is moved to a retracted position P6 above the apparatus by a moving mechanism 144 comprising a motor (not shown), and the drum 14 opening 16 is released, with the drum 14 disposed by the rotary mechanism 26 at the workpiece loading and shot processing position P4 where workpieces are loaded. At the workpiece loading and shot processing position P4, workpieces can be loaded into the drum 14, and the opening 16 of the drum 14 and the projector 18 are disposed in opposition to one another.

In this state, the workpiece loading means 34 does not interfere with the drum lid 142. Workpieces infed from outside the shot processing apparatus 140 by the workpiece loading means 34 are then loaded into the drum 14.

When loading of workpieces in the drum 14 is completed, the drum lid 142 is moved by the moving mechanism 144 to a closed position P7 at which the opening 16 of the drum 14 is closed, as shown in FIG. 9C. Next, the drum 14 is rotated about cylinder axial center L, stirring workpieces in the drum 14. In this state, shot processing is applied to the workpieces by the projection of projection material onto workpieces in the drum 14 from the projector 18 attached to the drum lid 142.

When shot processing is completed, the projector 18 is stopped and, as shown in FIG. 9B, the drum lid 142 is moved by the moving mechanism 144 to the retracted position P6 above the apparatus, releasing the drum 14 opening 16. As shown in FIG. 9D, the drum 14 is rotated about the rotation axis L2 by the rotary mechanism 26 to the retracted position P5. By this means, workpieces in the drum 14 are outfed to outside the shot processing apparatus 140 by the workpiece discharge means 40 (see FIG. 9A), thereby completing one sequence of work.

Second Embodiment Action and Effect

Next the action and effect of the second embodiment will be explained.

In the shot processing apparatus of the present embodiment, as in the shot processing apparatus of the first embodiment, the control cage 78 opening window 118 is arranged to be a rectangle with two sides parallel to the control cage 78 cylinder axial center CL, and projection material is discharged from the same position in the circumferential direction of the control cage 78. Projection material discharged from the opening window 118 contacts the surface 102 of blades 92 in the blade wheel 76 and is accelerated and projected from the tips of the blades 92.

In the shot processing apparatus of the present embodiment, as well, a rearward inclining portion 108 inclining to the rotational rear side relative to the radial direction is formed on the surface 102 of the blades 92 of the blade wheel 76.

Projection material discharged later from the opening window 118 of the control cage 78 therefore contacts the surface 102 of the blades 92 before the projection material discharged later from the control cage 78 opening window 118 contacts the surface 102 of the blades 92, and is moved toward the tip side of the blades 92 as it is accelerated.

In the shot processing apparatus of the present embodiment, first discharged projection material contacts the surface 102 at a position close to the position where later discharged projection material which has already moved along the surface of the blades 92 is present, therefore first discharged projection material and later discharged projection material are collected at close positions on the surface 102 of the blades 92.

The projection material is separated and projected from the blades in a collected state, therefore the projection distribution can be concentrated. That is, the distribution of projection material projected from the projector 18 forms a fan shape with a narrow opening angle.

This narrow opening angle means that the range over which the projection material strikes is also narrow even at positions distant from the projector 18. Therefore in the effective projection range A1 of projection material projected onto workpieces (see FIG. 4), the projection material projection fraction increases, as shown in the FIG. 8A projection distribution chart. In the drum inside wall projection range A2, cabinet projection range A3, and blade wheel inside projection range A4 (see FIG. 4), which are ranges outside the effective projection range A1, the projection material projection fraction decreases. That is, wasteful projection onto locations other than workpieces can be constrained, and the fraction of projection material projected toward workpieces can be increased. In this manner, processing time can be shortened.

In the shot processing apparatus of the present embodiment, a non-rearward inclining portion 110 is formed on the tip portion of the blades 92, therefore projection material can separate from the non-rearward inclining portion 110 when projected from the blades 92.

The projection velocity when projection material is projected is the combined velocity from centrifugal acceleration in the direction along the blade surface and the velocity in a direction tangential to the circle described by the tips of the rotating blades (referred to below simply as the tangent direction). When the blade rotation outside diameter and rotation circumferential velocity are the same, the combined velocity will decline when the blade is inclining rearward, because the tangential direction component of the velocity in the direction along the blade surface acts in the opposite direction relative to the velocity in the tangential direction. That is, the combined velocity when the blades are inclining rearward is lower than the combined velocity when the blades are not inclining rearward.

As described above, in the shot processing apparatus of the present embodiment the projection material contacts the non-rearward inclining portion 110 extending in the radial direction until immediately before projection, therefore the velocity in the direction along the surface 102 of the blades 92 caused by centrifugal acceleration at time of projection has only a radial component, and does not have a component which acts in the negative direction relative to the velocity in the tangential direction. The velocity in the direction along the blade surface due to centrifugal acceleration therefore does not reduce the combined velocity. As a result, the rpm of the blade wheel 76, i.e., the rpm of the motor rotating this blade wheel, is not increased, and efficient shot processing can be accomplished while reductions in projection electrical power efficiency can be constrained.

In addition, the radial length of the blade wheel 76 rearward inclining portion 108 is set to be longer than the radial length of the non-rearward inclining portion 110, therefore projection material can be sufficiently collected by the blade 92 rearward inclining portions 108. As a result, processing time can be even more significantly shortened.

In addition, it is sufficient to dispose the drum 14 at two locations only: the workpiece loading and shot processing position P4, and the workpiece discharge position P5, therefore the structure for rotating the drum 14 can be simplified and costs can be constrained.

The range over which projection material hits is narrowed at positions distant from the projector 18, and wasted projection relative to workpieces in the drum 14, i.e., the fraction of projection material projected to the drum 14 or the cabinet 12, etc., can be reduced. Wear of the shot processing apparatus 140 itself, such as the drum 14 or the cabinet 12, can thus be constrained, and the frequency of maintenance of the shot processing apparatus 140 can be reduced.

In addition, the total projected amount of projection material declines, so the total amount of projection material circulating in the shot processing apparatus 140 decreases, such that the circulating apparatus 46 for circulating the projection material can be made compact.

Without limitation to the embodiments of the present invention above, various changes and variations are possible within the technical concepts set forth in the Claims.

As described above, in the present specification the phrase "inclining angle is smaller toward the rotational direction rear side than the rearward inclining portion" includes a constitution in which the inclining angle is smaller than the inclining angle of the rearward inclining portion to the rotational rearward side, a constitution extending in the radial direction, and a constitution inclining to the rotational direction forward side, therefore the non-rearward inclining portion has a constitution inclining to the rotational direction rearward side, but a constitution in which that inclining angle is smaller than the inclining angle of the rearward inclining portion, or a constitution inclining to the rotational forward side in the radial direction is also acceptable. It is also acceptable not to provide a non-rearward inclining portion.

For example, a centrifugal projector described below may be used in the above embodiments of the shot peening apparatus according to the present invention.

Below, referring to drawings, such centrifugal projector alternatively used in the above embodiments of the present invention will be explained. As shown in FIGS. 11 through 13A-13F, a centrifugal projector 301 used in an embodiment of the present invention comprises a plurality of blades 303; the blades 303 are rotated and projection material 302 ("projection material" is also referred to below as "shot") is projected by centrifugal force.

As shown in FIGS. 13A-13F through 15A-15C, the projection surface 303*a* of each blade 303 has a first part 303*b* forming the radial inner part of the projection surface 303*a*, and a second part 303*c*, positioned radially outside the first part 303*b* and forming the outer part of the projection surface 303*a*. The second part 303*c* of the blade 303 is disposed as an integral part of the first part 303*b*, mediated by a bend or curved portion relative to the first part 303*b*. In the blade 303 explained here, the first part 303*b* and second part 303*c* are disposed through a curved portion 303*d*. The shape explained here is the shape of a cross section perpendicular to the rotary shaft of the blade 303.

Figures 15A, 15B, 15C:
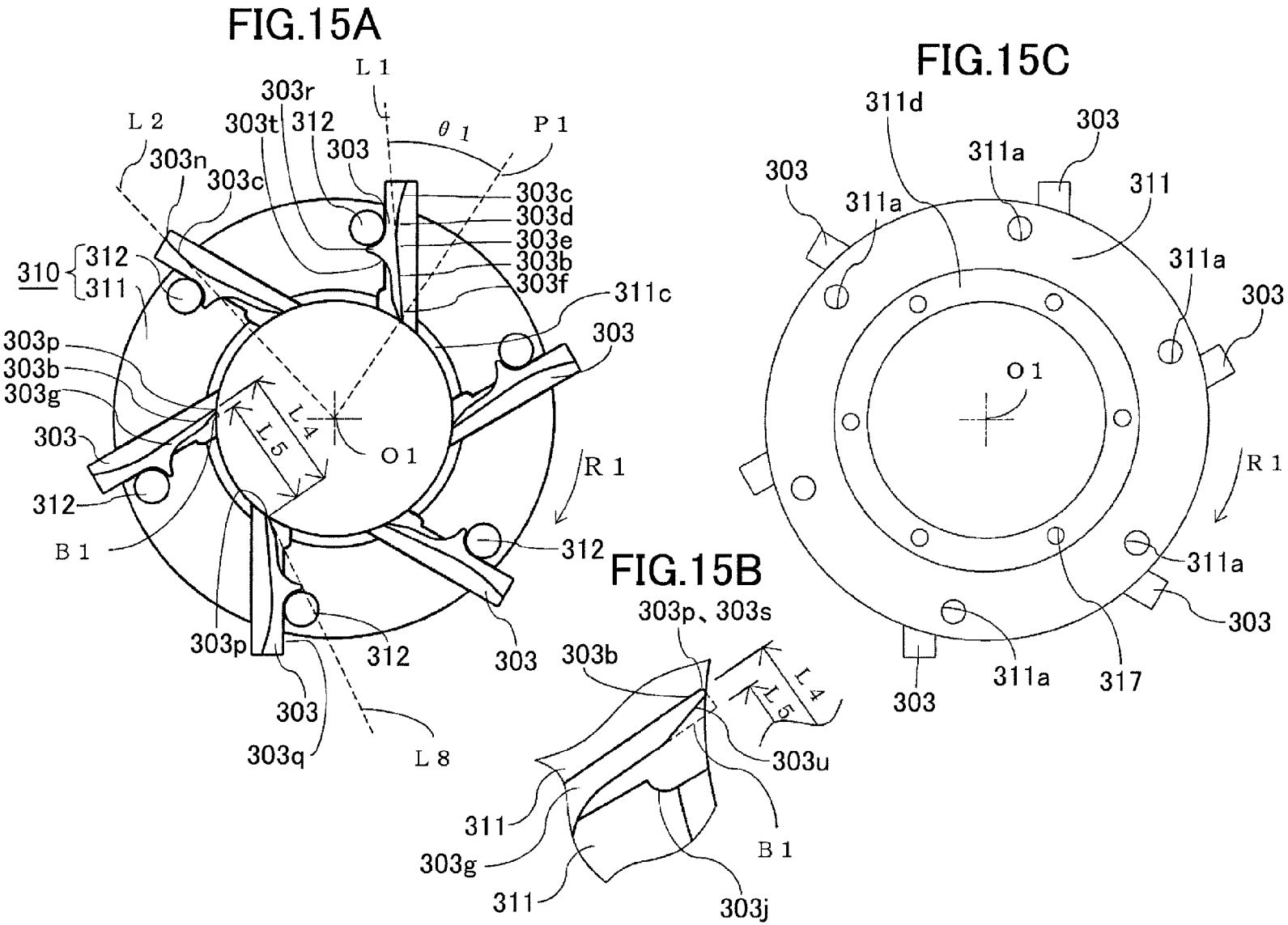
FIGS. 15A-15C are diagram showing the blade and the side plate unit of the centrifugal projector shown in FIG. 11.

As shown in FIGS. 15A-15C, the outer side 303*e* of the first part 303*b* of the blade 303 is formed so that its outer side 303*e* inclines to rear side of the rotational direction R1 with respect with respect to the inner side 303*f*. The rotational direction R1 is the direction of rotation of the blade 303 and the side plate unit 310, etc., described below. In other words, the first part 303*b* of the blade 303 inclines relative to the line which includes the rotational center (the normal line). Note that the first part 303*b* of the blade 303 is formed in a straight line, but may also be a curved shape. However, a straight line shape is advantageous from the standpoint of the shot-concentrating function, and for manufacturing.

The second part 303*c* of the blade 303 is formed to be positioned more to the front side of the rotational direction R1 than the imaginary line L1, which extends the first part 303*b* outward. Note that the second part 303*c* of the blade 303 is formed with a curved shape, but may also be formed in a straight line. However, from the standpoint of the shot acceleration function described below and for manufacturing, a curved shape is advantageous. Also, in blade 303 the curved portion 303*d* is integrally formed as a single piece with the curved shape of the second part 303*c*, but blade 303 is not limited thereto.

As described above, the first part 303*b* of the blade 303 is rearwardly inclined in the rotational direction, so projection material can be concentrated. For the inclined angle θ1 of the first part 303*b* of the blade 303, an angle of 30° to 50° has a favorable effect, as described below (see FIGS. 15A-15C). Here "inclined angle" means the angle relative to plane P1, which includes the rotary shaft of blade 303. In the figure, O1 indicates the rotational center (rotary shaft of blade 303). Also, because the first part 303*b* of the blade 303 is formed at a pitch, projection speed of the projection material is decreased, but this can be compensated by the second part 303*c* function of accelerating projection material; i.e., a drop in projection speed of the blade 303 can be prevented, and projection speed maintained. Note that because the second part 303*c* of the blade 303 is formed to be positioned more to the rotational direction R1 front side than imaginary line L1, which extends the first part 303*b* outward, projection material can be accelerated by the second part 303*c*. Hence the blade 303, by means of the first part 303*b* and second part 303*c*, can concentrate projection pattern of the projection material without decreasing the projection material speed, and projection efficiency can be increased.

Also, as shown in FIGS. 13A-13F, each blade 303 has a blade projection portion 303*g* with a projection surface 303*a* for projecting projection material, and a pair of attachment portions 303*h* positioned on both edge portions of the blade projection portion 303*g*. Here, assuming the direction parallel to the axial direction of the rotary shaft of the blade 303 is first direction D1, the attachment portions 303*h* are respectively disposed on both edges of first direction D1 of the blade projection portion 303*g*. These attachment portions 303*h* are formed to have a greater thickness than the thickness of the blade projection portion 303*g* (the thickness in thickness direction of the blade projection portion 303*g* (e.g., second direction D2)), and are integrated with this blade projection portion 303*g* (see FIGS. 13D and 13E. Note that the second direction D2 is perpendicular to the first direction D1 in the top view (plan view) shown in FIGS. 13A-13F.

Also, the attachment portions 303*h* of the blade 303 are formed so that at least the plane of the outside part 303*i* thereof perpendicular to the direction of the rotary shaft forms a straight shape. That is, the blade projection portion 303*g* has a curved or bent shape as described above, but the majority of the outside part of the attachment portions 303*h* (the majority of the parts other than the inside parts described below) are straight shapes without curves or bends. In FIGS. 13A-13F, reference numeral 303*h*3 indicates the part formed in a straight shape on the attachment portions 303*h*.

As described above, the attachment portions 303*h* of the blade 303 are given a straight shape, facilitating the work described below of attaching to the side plate unit 310, the work of removing from the side plate unit 310, and so forth. Thus, in blade 303, changing operation of a blade projection portion 303*g*, (blade 303) comprising a first part 303*b* and second part 303*c* for increasing projection efficiency as described above, relative to the side plate unit 310, can be easily accomplished.

Also, the attaching portions 303*h* of the blade 303 have a locking portion 303*j* on the radial inside part. The shape of the locking portion 303*j* in the plane perpendicular to the rotary shaft direction of the blade 303 is formed to project from the straight shape described above (see FIGS. 13B and 13D). Moreover, a plurality of contacting portions 303*k* (two each here) are disposed on the outside in the direction D1 of the pair of attachment portions 303*h*. The contacting portions 303*k* are formed to project from the outside surface 303*m* of the attachment portions 303*h*. With the blade attached to the side plate unit 310, the contacting portions 303*k* are made to contact the channel portion (guide channel portion 313) disposed on the side plate 311, and are attached at an appropriate position.

The blade 303 has a locking portion 303*j*, enabling accurate attachment to a predetermined position on the side plate unit 310 so that favorable projection performance can be achieved. Also, by bringing the contacting portions 303*k* into contact with the channel portion without the outside surface 303*m* of the attachment portions 303*h* of blade 303 directly contacting the channel portion of the side plate 311, the blade 303 can be smoothly attached when attaching it to the side plate unit 310.

The blade projection portion 303*g* and attachment portions 303*h* are formed so that the spacing L3 of the inside surfaces 303*h*1 opposing the pair of attachment portions 303*h* becomes gradually smaller toward the outside with respect to the inside in the radial direction. That is, the opposing inside surfaces 303*h*1 on the pair of attachment portions 303*h* are slightly inclined. In other words, the inside surfaces 303*h*1 are mutually inclined, and are also inclined relative to the outside surfaces 303*h*2. The outside surfaces 303*h*2 on the pair of attachment portions 303*h* are essentially parallel. The outside surfaces 303*h*2 are parallel to the main surface of the side plate 311. The spacing L3 between the two edge portions 303*g*1 in the front elevation shown in FIG. 13A of the blade projection portion 303*g*, i.e., the spacing L3 in the first direction D1 of the two edge portions 303*g*1, is formed to become gradually smaller toward the outside with respect to the inside in the radial direction.

Since the blade 303 thus has a blade projection portion 303*g* and attachment portions 303*h*, widening of the grouped projection material in the first direction D1 toward the radial outward direction within the centrifugal projector 301 can be prevented. That is, the blade 303 contributes to the concentration of the projection material projection pattern, and has good compatibility with the above-described shapes of the first part 303*b* and second part 303*c*, so that the projection pattern can be concentrated by a synergistic effect. Note also that in the blade of the present invention the inside surfaces 303*h*1 and two edge portions 303*g*1 are not limited to being inclined; even if parallel, the other effects are present.

Also, the second part 303*c* of the blade 303 is formed so that an imaginary line connecting the rotational center of the blade 303 to a point close to the outside end portion of the second part 303*c* matches the normal line, so the above-described projection material accelerating function can be achieved. Here the imaginary line L2 connecting the blade 303 rotational center to the second part 303*c* outside end portion 303*n* is formed to match the normal line (see FIG. 15A, etc.).

In the second part 303*c* of the blade 303 constituted as described above, the projection material projection speed can be essentially the same as the projection speed when there is a flat projection surface formed to match the normal line. That is, the blade 303 can concentrate the projection pattern without decreasing the projection speed, so that projection efficiency can be increased.

Note that in blade 303, the imaginary line L2 is formed to match the normal line to achieve essentially the same speed as the projection speed when there is a flat projection surface, but the blade 303 is not limited thereto. That is, from the standpoint of achieving the acceleration function, the imaginary line L2 can also incline forward in the rotational direction more than the normal line in the blade 303. In other words, the imaginary line connecting the blade 303 rotational center O1 to the radial inner side from the second part 303*c* outside end portion can be formed to match the normal line.

The end portion 303*p* of the blade projection portion 303*g* is formed in a shape which tapers toward the inside, and by enlarging the distance between the inside end portions 303*p* on each blade can function as a guide portion for increasing the amount of projection material guided between each of the rotating blades 303. That is, the end portions 303*p* as guide portions increase the amount of projection material guided between each of the blades 303. In other words, when an end portion is not formed in a tapered shape (the case shown by the dotted line B1 in FIGS. 15A and 15B), projection material colliding with that part bounces back, but when an end portion 303*p* formed in a tapered shape is adopted, the blade end portion does not interfere, and projection material enters in, increasing the amount of projection material guided between each of the blades 303.

As described below, the present inventors conducted repeated simulations and experiments, but came to understand that when the inside end portion of a blade projection portion 303*g* is formed to be thick, and the end portion on the inside of the blade projection portion 303*g* is not formed to be thick (the case shown by dotted line B1 in FIGS. 15A and 15B), projection material bounces back toward the center in that part (the end portion part on the thick inside). By forming the blade projection portion 303*g* inside end portion 303*p* in a tapered shape, as in the blade 303 described above, the distance L4 between the end portions 303*p* on the inside of the blade 303 can be enlarged. That is, the distance L4 can be made large with respect to the distance L5 between the end portions in the case shown by dotted line B1. The dotted line B1 indicates a comparative example relative to the tapered shape. As shown by the distance L4, the amount of projection material introduced between the rotating blades 303 can be increased using a tapered shape. In addition, bounce back of projection material toward the center can be reduced. Hence a favorable projection pattern can be achieved.

The blade projection portion 303*g* has a raised portion 303*r* formed on a projection back surface 303*q* disposed on the opposite side to the projection surface 303*a*. The blade projection portion 303*g* has a curved surface 303*t* disposed between the raised portion 303*r* and an end portion 303*s* on the blade projection portion 303*g*. Note that here a curved surface 303*t* is formed starting from the end portion 303*s* on the projection back surface 303*q*, mediated by the taper-forming portion 303*u* and the planar portion 303*v*. The taper-forming portion 303*u* forms the above-described first part 303*b* and the above-described tapered end portion 303*p*. Also, a curved surface 303*x* is formed between raised portion 303*r* and outside end portion 303*w* in the blade projection portion 303*g*. As described below, a side plate unit 310 connecting member 312 can be disposed on this curved surface 303*x*. Note that the taper-forming portion 303*u* was formed in a planar shape here, but may also be formed in a curved shape, and furthermore may be formed as part of the curved surface 303*t*, without going through the planar portion 303*v*.

The above-described curved surface 303*t* on the radial inside of the blade 303 enables the projection material 302 to be smoothly guided to the projection surface 303*a* side of the next blade 303 (the next blade 303 to come around in rotation). This enables a connecting member (stay bolt) 312 to be disposed on the reverse side of the raised portion 303*r* on which the curved surface 303*t* is formed, so that a return toward the center (rotational center of blade 303) of projection material which has hit the connecting member (stay bolt) 312 can be prevented. Hence a centrifugal projector 301 comprising this blade 303 and side plate unit 310 can produce a favorable projection pattern.

As shown in FIGS. 15A-15C and 16A-16B, a centrifugal projector 301 alternatively used in an embodiment of the present invention comprises a side plate unit 310 for attaching the above-described plurality of blades 303. The side plate unit 310 has a pair of side plates 311 and a connecting member 312 for connecting this pair of side plates 311 at a predetermined separation distance. The connecting member 312 is inserted into a hole 311*a* formed in the pair of side plates 311 and fixed. It is fixed, for example, by swaging or screwing. The connecting member 312 is a member referred to, for example, as a stay bolt.

A guide channel portion 313 is formed in the surfaces 311*b* mutually facing the pair of side plates 311. Also, the pair of side plates 311 is a donut-shaped (ring-shaped) member, and a taper portion 311*c* is disposed on the inside of the mutually opposing surfaces 311*b*. The guide channel portion 313 is formed at a pitch so as to be positioned on the rotational direction rear side with respect to the outer side 313*a* and inner side 313*b* thereof. The shape explained here is the shape in the cross section perpendicular to the rotary shaft (rotational center) of the blade 303 and the side plate unit 310. Note that the guide channel portion 313 corresponds to the attachment portions 303*h* of the blade 303; the attachment portions 303*h* of the blade 303 are slid in and inserted to attach the blade 303 to the side plate unit 310.

In such a side plate unit 310, the blades 303 can be reliably attached while demonstrating their performance in concentrating the projection pattern as described above. Blades 303 can also be easily replaced.

In the guide channel portion 313 of the side plates 311 on the side plate unit 310, at least the outside part 313*c* thereof is formed in a straight shape. Also, in the guide channel portion 313 the inside part 313*d* is formed to have a broader width than the straight shape. The inside part 313*d* of the guide channel portion 313 locks to the locking portion 303*j* on the attachment portions 303*h* of the blade 303 and regulates the position of the blade 303 (attachment portions 303*h*). The outside part 313*c* shows the part of the guide channel portion 313 formed in a straight shape. This guide channel portion 313 outside part 313*c* corresponds to the straight shaped part 303*h*3 of the attachment portions 303*h*. The imaginary center line L6 of the straight-shaped part 313*c* is tilted in the rotational rear direction (see FIGS. 16A-16B). The inclined angle θ2 is set at an angle close to the blade tilt angle, for which an angle of 30° to 50° is favorably effective. Here "inclined angle" means the angle relative to plane P2, which includes the rotary shaft of blade 303.

Since the guide outside part 313*c* of the channel portion 313 on the side plates 311 is given a straight shape, blades 303 can be easily replaced. That is, the blades 303, which implement the functions of concentrating and accelerating projection material, can be appropriately attached. In other words, while the first part 303*b* and second part 303*c* are formed on the projection surface 303*a* of the blade projection portion 303*g* as described above, the attachment portions 303*h* and guide channel portion 313 have a straight shape, therefore the blades 303 can be attached and removed in a simple and smooth manner.

Also, the locking portion 303*j* of the attachment portions 303*h* on the blade 303 can lock to the inside part 313*d* of the guide channel portion 313 on the side plates 311, therefore the blades 303 can be fixed, at an appropriate position.

The connecting members 312 on the side plate unit 310 are provided in the same number as the number of blades 303. Each connecting member 312 is positioned between the blades 303. In addition, connecting members 312 are disposed at positions closer to the projection back surface 303*q* than the midway position between the blade 303 projection surface 303*a* and the projection back surface 303*q* on adjacent blades 303. Note that to obtain the midway position, a calculation is made of an imaginary arc L7 passing through the center position of the connecting member 312, and of intersections K1, K2 with the above-described imaginary line L6, centered on O1 (see FIGS. 16A-16B). It is sufficient to be on the imaginary arc L7, and to designate the point K3 positioned midway between these intersections K1, K2 as the "midway position." In such cases, the connecting member 312 is positioned on the projection back surface 303*q* side of the midway position K3. The "midway position" is not limited to this; it is also possible to calculate the intersection between the arc L7 and the projection surface 303*a* and the intersection between the arc L7 and the projection back surface 303*q* and use a point positioned on the arc L7 and between these intersections.

As shown in FIGS. 15A-15C, in a cross section within a plane perpendicular to the direction of the rotary shaft, the imaginary line connecting from the tip of the end portion 303*p* inside the blade projection portion 303*g* so as to contact the raised portion 303*r* formed on the projection back surface of the blade projection portion 303*g* (contact close to the peak of the raised portion 303*r*) is deemed to be imaginary line L8. Relative to this imaginary line L8, a favorable projection pattern can be formed by disposing the connecting member 312 in a position where the connecting member 312 is close to the blade 303 projection back surface 303*q*, so that at least a part of the cross section of the connecting member 312 is positioned on the projection back surface 303*q* side of the blade 303. Here, furthermore, the connecting member 312 is disposed in a position close to the projection back surface 303*q* of the blade 303 so that, relative to this imaginary line L8, the surface area of the cross section in the part on the side of the projection back surface 303*q* of the blade 303 is half or more of the cross section of the connecting member 312, therefore a favorable projection pattern can be formed.

The side plate unit 310 thus constituted prevents projection material which has collided with the connecting member (stay bolt) 312 from returning to the center side. Hence a centrifugal projector 301 comprising this blade 303 and the side plate unit 310 can produce a favorable projection pattern.

The number of the above-described blades 303 is six. This means that with respect to cases in which 308 or 312 units are provided, the distance between the end portions on the inside between each blade can be increased, and bounce back of projection material toward the center at the end portions of each blade can be reduced; i.e., the projection pattern can be improved. This is also just right when considering the same number of connecting members (stay bolts). In other words, the same number of connecting members 312 were provided as for the blades 303 described above, but if the number of connecting members 312 becomes excessive, the potential increases for projection material which has bounced back at the connecting members to return to the center side. On the other hand if six blades and connecting members are provided, the effect of the connecting members can be reduced and a favorable projection pattern achieved. If the number is reduced too much, for example to four, blade friction becomes a problem, and the frequency of blade replacement increases, along with maintenance person hours. Increases in the time difference in projection material (projection material supplied from the control cage opening window 321*a* described below) supplied to each blade leads to the problem of increased blade size in the radial direction, and increased blade weight. In light of the above, 306 to 308 blades is an appropriate number, and 306 is the optimal number in the present invention.

Figure 16B:
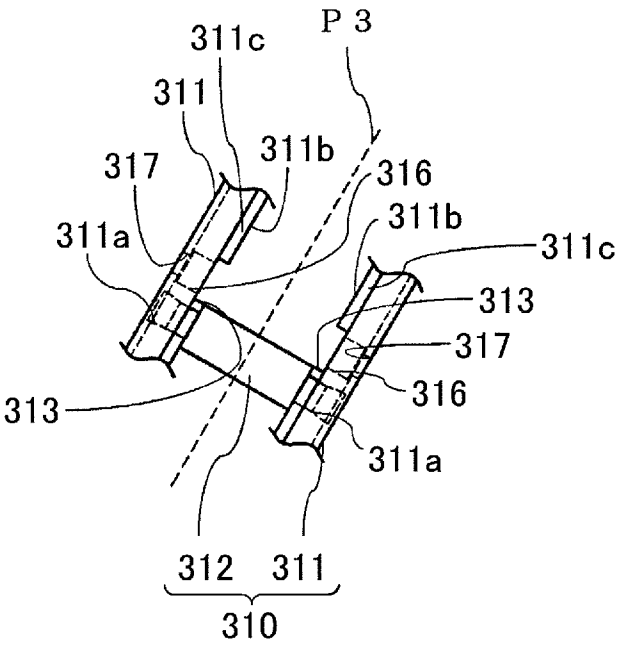
FIGS. 16A and 16B are diagram showing the side plate unit shown in FIGS. 15A-15C.
Figure 16A:
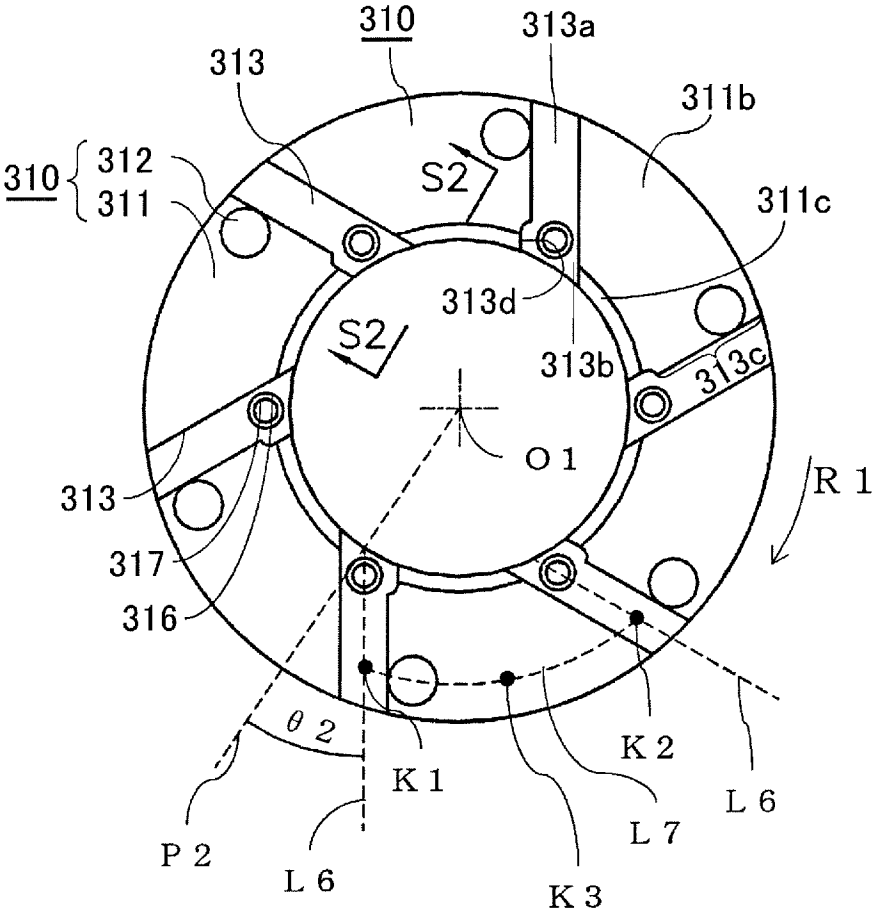
Figure 17:
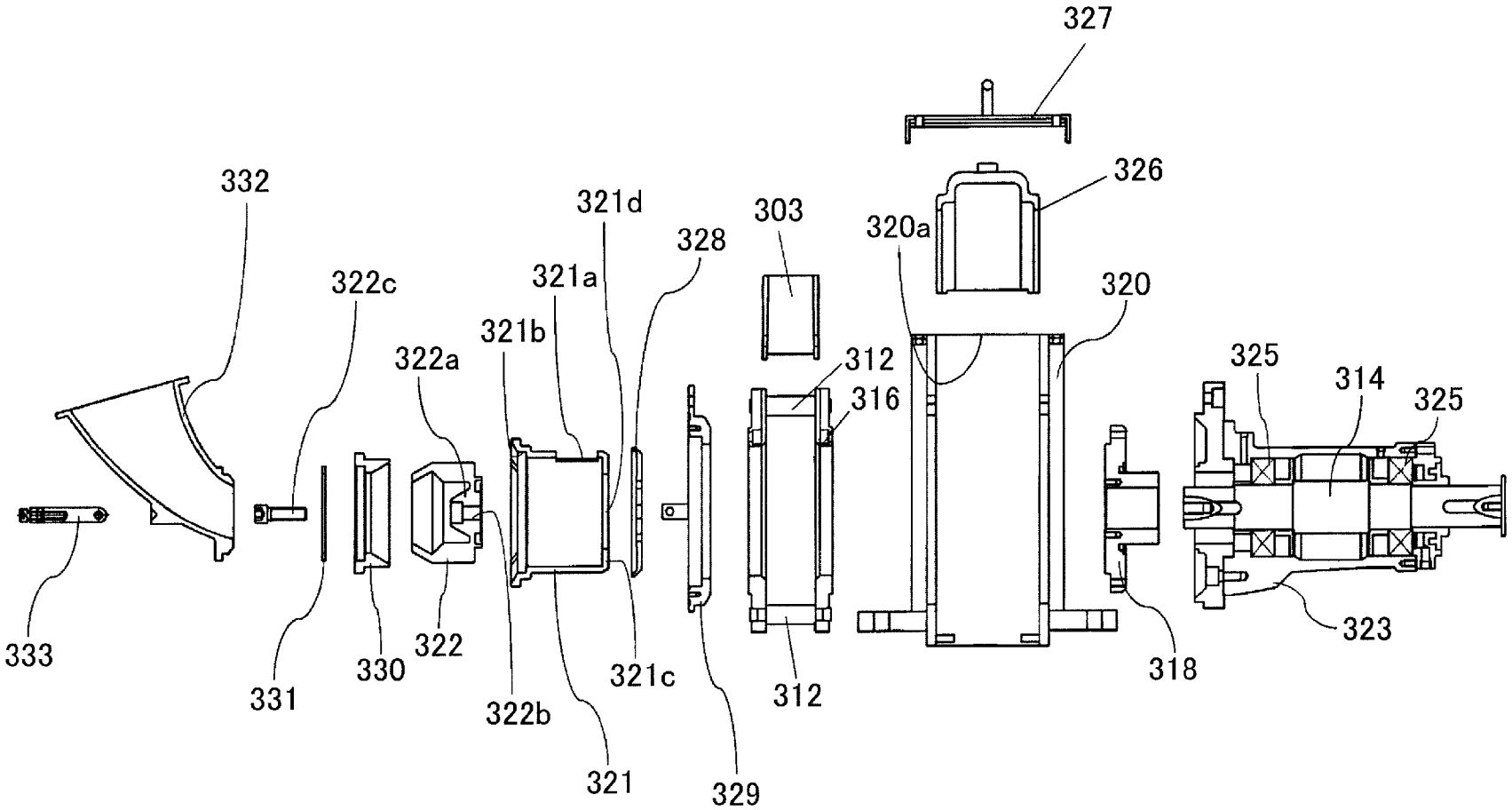
FIG. 17 is a component exploded view showing the separate major parts of the centrifugal projector shown in FIG. 12.
Figure 18A:
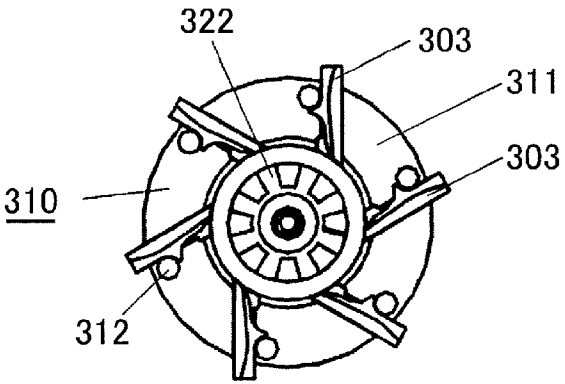
FIGS. 18A-18D are diagrams showing the major parts, partially separated, of the centrifugal projector shown in FIG. 11.
Figure 18C:
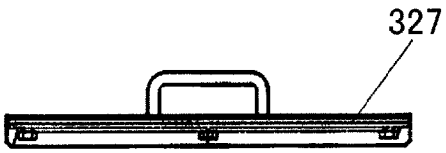
Figure 18B:
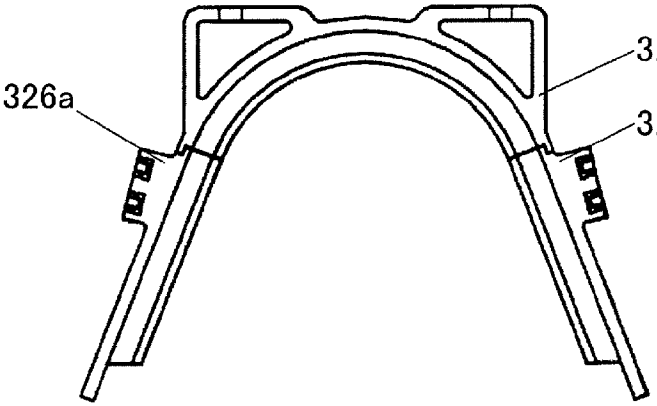
Figure 18D:
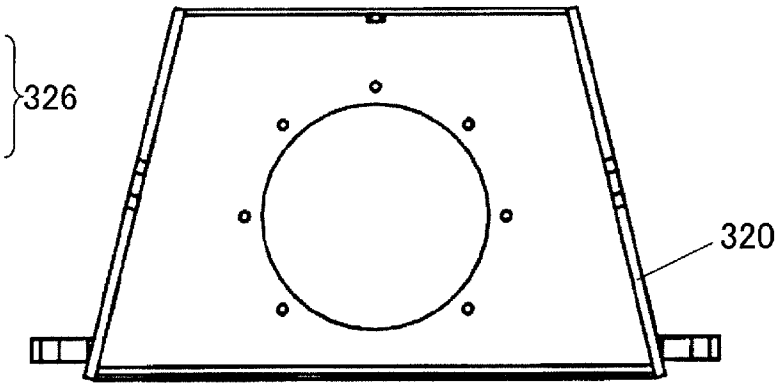
Figures 19A, 19B, 19C, 19D, 19E, 19F, 19G, 19H, 19I, 19J, 19K, 19L, 19M, 19N:
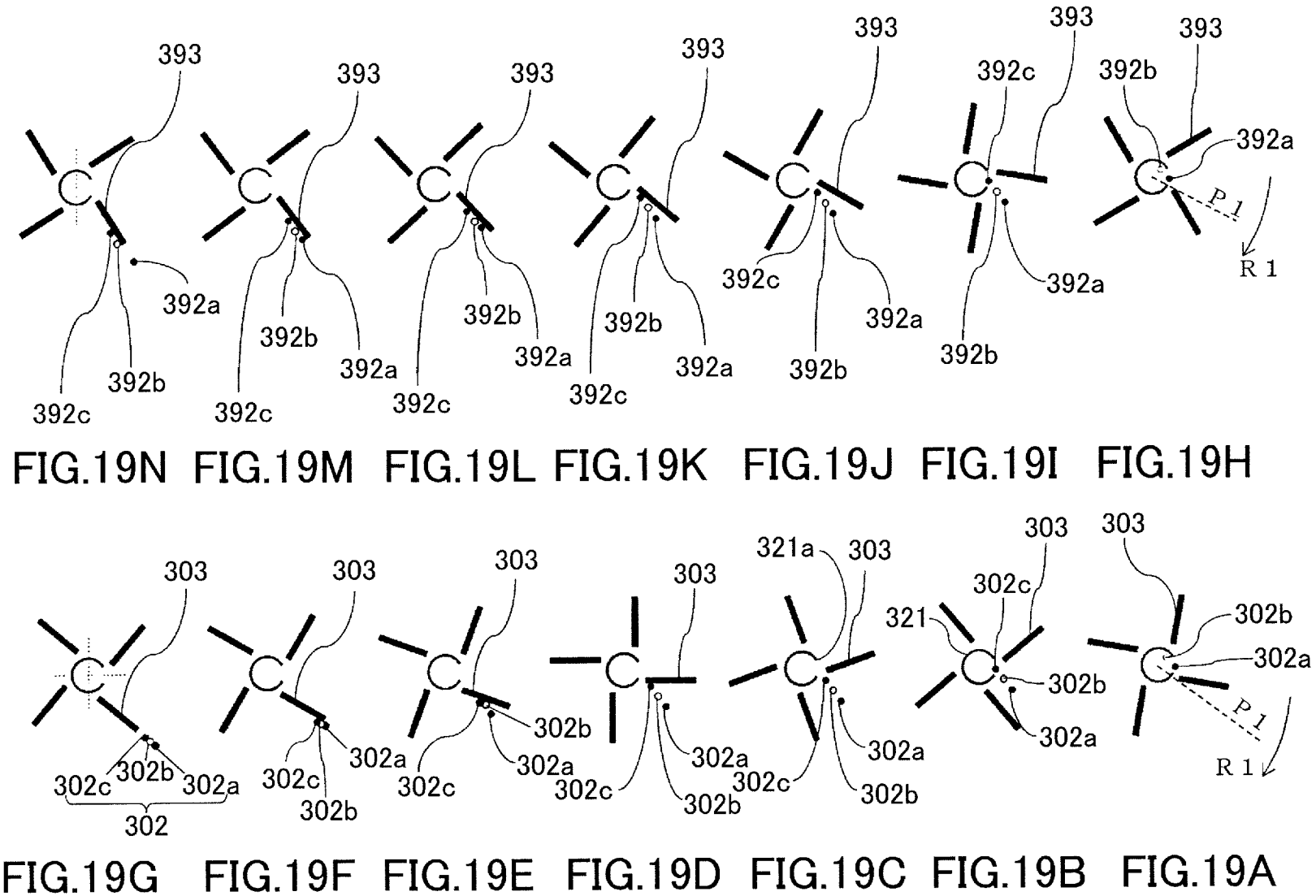
Figures 20A, 20B, 20C, 20D, 20E, 20F:
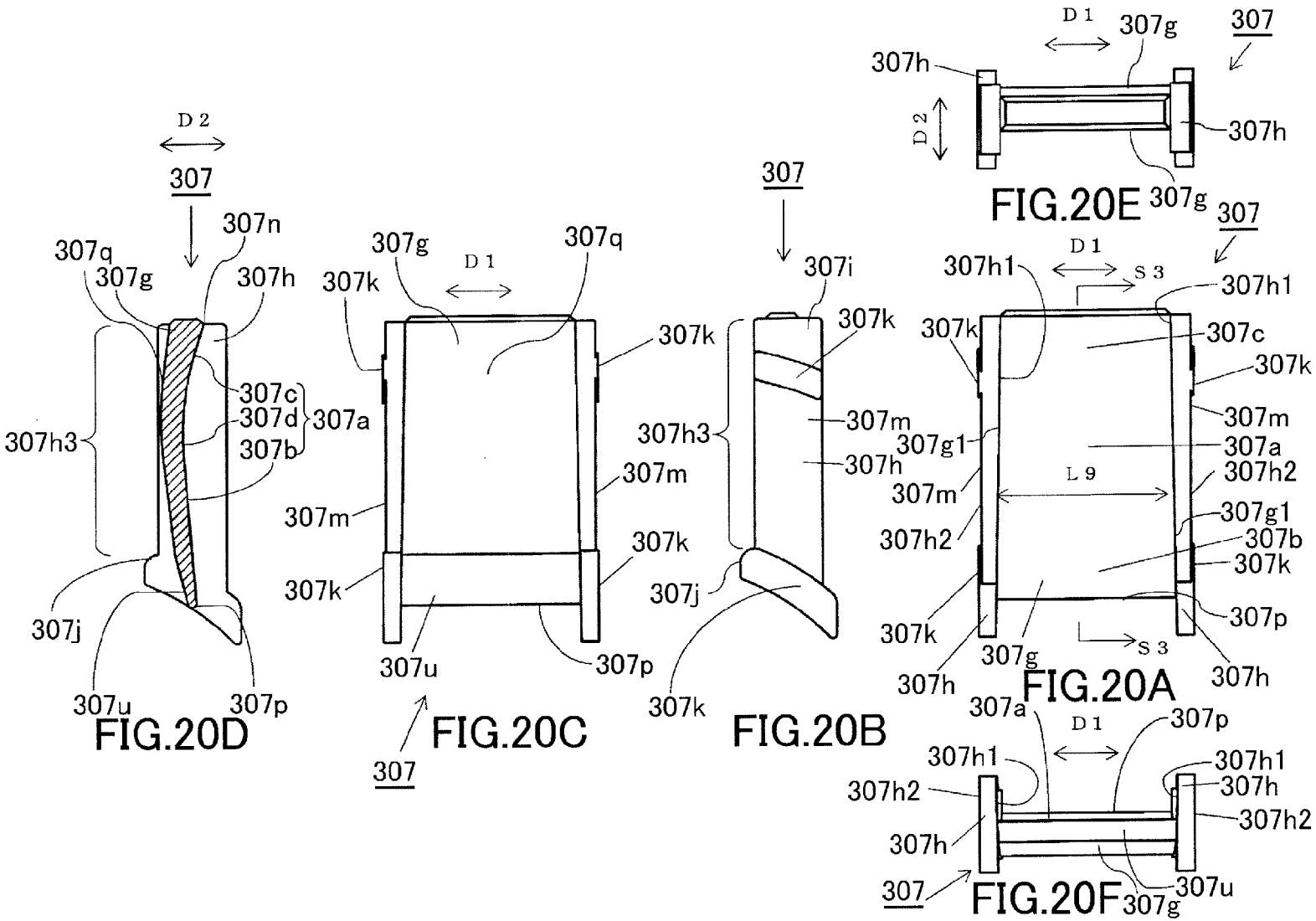
FIGS. 20A-20F are diagrams showing another example of a blade which can be used in a centrifugal projector according to an embodiment of the present invention.
Figure 21A:
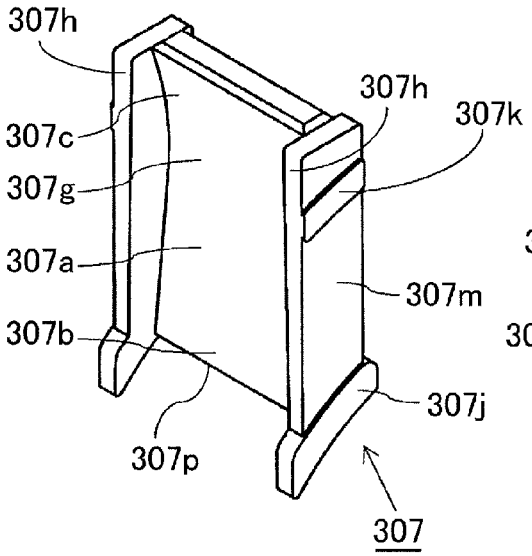
FIGS. 21A-21D are perspective views showing the blade shown in FIGS. 20A-20F.
Figure 21B:
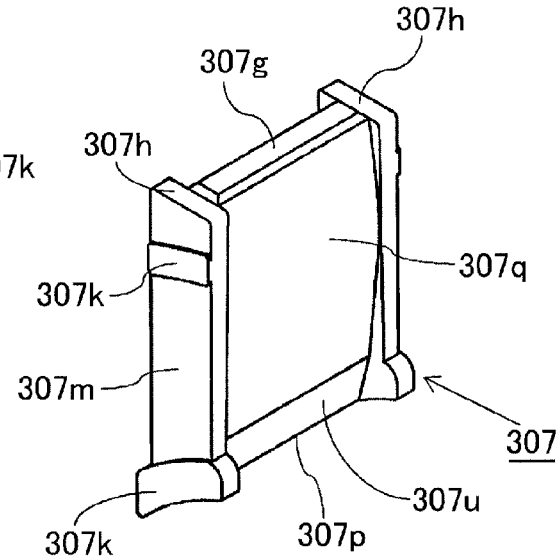
Figure 21C:
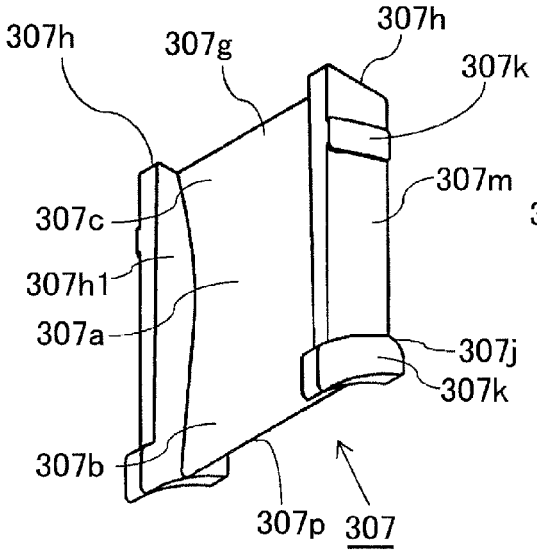
Figure 21D:
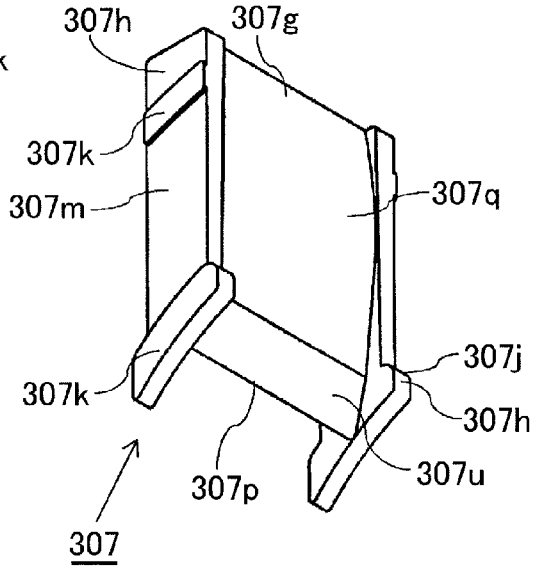

As shown in FIGS. 16A-16B, a recessed portion 316 for attaching a bolt 315 to fix the side plate unit 310 to the rotary drive side is provided on the guide channel portion 313 of the side plates 311. Rotary drive side here means the hub 318 fixed to the rotary shaft 314 rotated in the rotary drive section (see FIGS. 12 and 17). An insertion hole 317 into which the bolt 315 is inserted is formed in this recessed portion 316. On the pair of side plates 311, a thick portion 311*d* is formed on the inside perimeter portion of the surface (outside surface) on the opposite side of mutually opposing surfaces, and the insertion hole 317 is positioned on the thick portion 311*d*.

The recessed portion 316 and insertion hole 317 are provided in the side plates 311, therefore fixing to and removal from the rotary shaft 314 side (hub 318) of the side plate unit 310 can be performed from the side plate unit 310, i.e., in the main unit case 320. By providing a recessed portion 316 for attaching a bolt 315 to the guide channel portion 313, the bolt 315 head portions 315*a* are hidden by the attachment portions 303*h* on the blade 303 after attachment of the blades 303 to the guide channel portion 313 of the side plate unit 310. As a result, the bolt 315 head portion 315*a* is not abraded. Also, fixing to and removal from the side plate unit 310 rotary driver side (rotary shaft 314, hub 318) can be performed from the side plate unit 310 side. Attachment of the side plate unit 310 to the hub 318, which is on the rotary drive side, was conventionally frequently done from the hub 318 (rotary shaft side), which was inconvenient. Here, because fixing of the side plate unit 310 rotary drive side can be performed from the side plate unit 310 side, attaching work is eased and convenience improved.

The pair of side plates 311 is formed to be plane-symmetrical relative to the imaginary plane P3 perpendicular to the connecting member 312 (see FIG. 16B). That is, the above-described recessed portion 316 and an insertion hole 317 for attaching the bolt 315 are placed on both of the pair of side plates 311. By changing the side of attachment of the pair of side plates 311 to the hub 318, the orientation of the guide channel portion 313 changes to the opposite side, and the orientation of the blades 303 changes to the opposite side. This enables reverse rotation of the rotary shaft 314 and the blade 303. By this means, the same product (processing target) can be supplied to each user desiring clockwise and counterclockwise rotation; i.e., general applicability can be improved.

Next, referring to FIGS. 11 through 18A-18D, the configuration of centrifugal projector 301 will be explained more specifically. The centrifugal projector 301 comprises a control cage 321 and a distributor 322. In addition, the centrifugal projector 301 comprises a main unit case 320, hub unit 323, hub 318, liner 326, lid 327, center plate 328, front cover 329, bracket 330, seal 331, hopper 332, hopper hold down 333, and the like.

The control cage 321 has the function of controlling the projection direction and distribution shape of the projection material. The side plates 311 which constitute the side plate unit 310 have a donut-shaped (ring-shaped) cross section. The control cage 321 is disposed and fixed on the inside of the side plates 311 (inside the inside diameter of the ring-shape). The opening window 321*a* is placed on the control cage 321. Projection material is released toward the blades from this opening window 321*a*.

The bracket 330 functions as a supplementary bracket for supplementing the control cage 321. That is, on the opposite side to its rotary shaft (the hopper 332 side), the control cage 321 has an insertion opening portion 321*b* into which the distributor 322 can be inserted from the opposite side (the hopper 332) to that rotary shaft. Also, on its rotary shaft side the control cage 321 has a cover portion 321*c* for covering the outside part on the rotary shaft side and in the radial direction of the distributor 322. Note that an opening 321*d* is provided on the inside of the cover portion 321*c*, large enough to enable the attachment of a bolt 322*c* for fixing the distributor 322 to the center plate 328 and hub 318. After the distributor 322 is attached, by fixing the bracket 330, along with the hopper 332, to the control cage 321 side, the gap between the control cage 321 and the hopper 332 can be blocked to prevent projection material 302 from being released to the outside from this gap.

As discussed above, the control cage 321 and bracket 330 can be inserted from the hopper 332 side (the opposite side to the rotary shaft 314) when the distributor 322 is disposed inside the control cage 321. By so doing, a cover portion 321*c* covering the outside part on the rotary shaft side and in the radial direction of the distributor 322 can be placed on the control cage 321. This cover portion 321*c* enables the gap between the distributor 322 and the control cage 321 on the rotary shaft side to be reduced, which allows leakage of projection material from this gap to be minimized, and projection material projection efficiency to be improved. The control cage 321 and bracket 330 greatly reduce work time when changing or maintaining the distributor 322.

The distributor 322 accelerates projection material supplied from the hopper 332 while stirring it, then supplies it to the blades 303 through the opening window (opening portion) 321*a* in the control cage 321. Openings are placed, for example, at essentially equal spacing in the circumferential direction on the distributor 322. The distributor 322 is rotatable inside the control cage 321.

Inside the distributor 322, an essentially triangular pyramid projection portion 322*a* forming a hole portion 322*b* for the attaching bolt 322*c* is formed on the interior of the distributor 322. A key channel is formed in the rotary shaft 314 and hub 318, which are linked so that they can rotate together using a key, not shown. A bolt (connecting member) 322*d* is connected to the center plate 328 and the hub 318. The bolt (connecting member) 322*c* connects the rotary shaft 314 and the distributor 322, gripping the center plate 328. The hub 318 has the function of transferring rotary force transferred from the rotary shaft 314 to the side plate unit 310 and the blades 303. The center plate 328 is a plate member with the function of blocking the opening on the rotary shaft side of the side plate unit 310, preventing leakage of projection material. The positional relationship in the radial direction is that the control cage 321 is disposed on the inside of the side plate unit 310, and the distributor 322 is disposed on the inside of the control cage 321. The presence of a member for transferring rotational force as described above results in the blades 303, side plate unit 310, hub 318, center plate 328, and distributor 322 being rotationally driven by the rotary shaft 314.

The hub unit 323 has a rotary shaft 314. This rotary shaft 314 is held by two bearings 325. A pulley for belt transferring drive force from a motor and a hub 318 for transferring to the side plate unit 310 are attached to the rotary shaft 314. The hub 318 has the function of connecting the rotary shaft 314 and the side plates 311 (side plate unit 310).

The side plate unit 310 allows for the attachment of blades 303, and is rotated together with the blades 303. Blades 303 rotate while being attached to the side plate unit 310, thereby projecting the projection material (shot). As described above, the centrifugal projector 301 has blades 303 with a concentrating function (the function of concentrating the projection material 302), side plates 311 to/from which blades 303 can be attached and removed, control cage 321, and distributor 322, so that a projection pattern can be concentrated, and projection efficiency over a narrow projection range can be improved. Using the centrifugal projector 301, projection material is concentrated on blades 303 with a concentrating function, and the concentrated projection material is released. At this point the projection material concentrated by the first part 303*b* is released from the second part 303*c*, which has a shot accelerating function, thereby improving projection efficiency is improved.

The purpose of the main unit case 320 is to assemble each constituent part. The liner 326 protects the main unit case 320 from projection material. A side liner 326*a* and a top liner 326*b* are used in the liner 326. The lid 327 opens and closes the upper opening 320*a* on the main unit case. The center plate 328 functions to prevent blades 303 from dropping and to protect the shaft end portion of the rotary shaft 314. The front cover 329 can be removed for maintenance.

The interior of the bracket 330 has a tapered opening, and projection material (shot) supplied from the hopper 332 is supplied into the distributor 322. The seal 331 prevents projection material from leaking out from the gap between the hopper 332 and the bracket 330. The hopper 332 supplies projection material into the centrifugal projector 301. The hopper hold down 333 fixes the centrifugal projector 301 main body to the hopper 332. An abrasion-resistant casting may be used for the hopper 332, in which case wear of the interior surface caused by projection material can be reduced, along with the frequency of replacements. It is permissible to use a material with lower abrasion characteristics than abrasion-resistant castings, but to prevent degradation of the flow of projection material due to abrasion of the inside surface requires replacement of parts at the appropriate timing.

Next the centrifugal projector attaching operation will be explained. The procedure for removal is the reverse of the above. The hub unit 323 is fixed to the main unit case 320 with a bolt or the like. To prevent abrasion by the projection material, a liner 326 is attached around the circumference of the rotary shaft 314 on the input surface of the main unit case.

The hub 318 is inserted into the rotary shaft 314 of the hub unit 323. The side plates 311 are fixed to the hub 318 from the inside surface of the centrifugal projector 301 by the bolt 315. Here the pair of side plates 311, separated by a certain distance, are fixed by the connecting member 312. That is, with the pair of side plates 311 connected by the connecting member 312, the side plate unit 310 is fixed to the hub 318.

The blades 303 are inserted from the inside toward the outside of the guide channel portion 313 on the pair of side plates 311, and are fixed by the center plate 328. Since centrifugal force acts in outward direction, a constitution in which blades are not fixed by the center plate 328 is also acceptable. When so doing, the locking portion 303*j* of the blades 303 locks to the inside part 313*d* of the guide channel portion 313, so the position of the blades 303 is appropriately placed.

The front cover 329 is fixed to the main unit case 320 with a bolt or the like. The center plate 328 is fixed by the bolt 315 to the hub 318, holding the inside diameter part of the blades 303 on its outer circumferential portion. After the control cage 321 is inserted into the pair of side plates 311, the distributor 322 is inserted therein, and the distributor 322 is fixed to the rotary shaft 314 by the bolt 322*c*.

On the control cage 321, the position of the opening window 321*a* is adjusted so projection material can be projected in the appropriate direction; the bracket 330, seal 331, and hopper 332 are attached in that order, and the control cage 321 is fixed while being held down by the hopper hold down 333.

The plurality of blades 303 are attached to the pair of side plates 311, separated by a gap, on the outside of the control cage 321. The distributor 322 is placed on the inside of the control cage 321, separated by a gap. The blades 303 and side plates 311, and the distributor 322, can be rotated about the same rotational center O1. The first part 303*b* of the blades 303 can also function as shot receiving portions. The second part 303*c* thereof also functions as a shot acceleration portion.

Next it will be explained a projection method using a centrifugal projector 301, and the motion of projection material projected by the centrifugal projector 301, used in the above-described embodiment of the present invention. The projection method using the centrifugal projector 301 has a step for scattered shot release from the control cage 321, a step for concentrating shot on the blades 303, and a step for releasing shot from the blades 303. That is, in the scatter release step, projection material is scatter-released from the opening window 321*a* on the control cage 321 toward the blades 303. In the concentrating step, the scatter-released projection material is concentrated on the blades 303. In the release step the projection material concentrated on the blades is released from the blades 303.

"Scatter release" here means that projection material is spread apart, scattered, and released. This means projection material is not released as an aggregated group, but a plurality of pieces is released in a spread-apart manner. "Concentration of projection material" refers to raising the density of the plurality of pieces of projection material released in a spread-apart manner onto the blades 303. "Release from the blades 303" refers to the release from the increased density projection material group from the blades 303 to the outside of the centrifugal projector 301. The blades 303 have the function of accelerating projection material received from the control cage by centrifugal force.

The motion of projection material together with the operation of the centrifugal projector 301 parts will be explained. First, the distributor 322, blades 303, side plate unit 310, and so forth are rotated. Next, projection material 302 is supplied into the distributor 322. The supplied projection material 302 is then supplied by centrifugal force from the opening in the rated distributor 322 into the gap between the control cage 321 and the distributor 322. The supplied projection material 302 moves through this gap in the direction of rotation. The projection material 302 moving through the gap flies outward from the opening window 321*a* in the control cage 321. The projection material 302 flying out from the opening window 321*a* is accelerated and concentrated by the first part 303*b* functioning as shot receiving portion; it is then further accelerated by the second part 303*c* functioning as shot accelerating portion, and is projected by centrifugal force from the outside of the blades 303.

Here it will be explained the advantages of the blades 303 in the centrifugal projector 301 used in the above-described embodiment of the present invention. In the conventional blades we compare with the above blades, the first part is not inclined with respect to a plane P1, and no second part is provided. That is, conventional blades have a projection surface with an essentially flat surface (the plane P1 shown in FIG. 15A), and the normal line and rotary shaft are included in this surface. With conventional blades, projection material leaving the opening window in the control cage at different times is projected from the blades with that time difference intact. This results in a broad projection pattern.

In contrast, the blades 303 on the above-described centrifugal projector 301 have the following advantages because the first part 303*b* is inclined rearwardly relative to the plane P1. These advantages will be explained along with the behavior of the projection material 302 using FIGS. 19A-19G. In FIGS. 19A-19G, in order to explain the behavior thereof in an easily understood manner. A part of the projection material 302 released in great volume is selected for the projection material 302*a*-302*c*, (the same is true of the projection material 392*a*-392*c* shown in FIGS. 19H-19N). In the rearwardly inclined blades 303 described above, the last projection material 302*c* to have left the opening window 321*a* first lands on the blades 303, then advances to the outer circumference of the blade as it is being accelerated. When projection material 302*b* which has left the opening window 321*a* midway between the end and start lands on the blades 303, the projection material 302*c* which first landed on the blades 303 is present in close proximity to it. These final and midway projection materials 302*c*, 302*b* are accelerated, so when projection material 302*a* which has left the opening window 321*a* at the beginning lands on the blades, these final and midway projection materials 302*c*, 302*b* are present in close proximity to it. Hence when the above-described blades 303 are used, the projection pattern of the projection material supplied at different times from the opening window 321*a* on the control cage 321 can be narrowed by projection from the blade tips with essentially no time difference.

For comparison with the rearwardly inclined blade explained in the above-described FIGS. 19A through 19G we explain, referring to FIGS. 19H-19N, the behavior of the projection material 392 when blades 393 (comparative example) are inclined forward relative to the plane P1, opposite the direction of the blades 303. In the forward-inclined blades 393, the dispersion area for supplied projection material, which connects together the projection material 392*a* which first left from the opening window with the projection material 392*c* which last left the opening window, is essentially parallel to the blades 393. The projection material 392*a* which first left from the opening window, the projection material 392*b* which left midway between the beginning and end, and the projection material 392*c* which last left the opening window therefore all land on the forward-inclined blades 393 at essentially the same time, and the projection pattern widens by the amount of time during which the projection material 392*b* moves over the forward-inclined blades 393 to the position of the projection material 392*a*.

The constitution and advantages of the above-described first part 303*b* of the blades 303 were discovered by the present inventors by careful examination of the behavior of projection material supplied to blades, and of repeated simulations and experimentation. The present inventors also carefully examined the behavior of blades inclined forward relative to the plane P1, and comparing these elements determined the constitution described above. In addition, with respect to the advantages of the second part 303*c* described next, the appropriate range of the inclined angle θ1, and the above-described number of blades 303, the inventors succeeded through repeated simulations and experiments in finding an advantageous and feasible solution and were able to make something which can be mass produced and which is feasible in light of the fact that blades are consumable parts.

Next the advantages of the second part 303*c* will be explained in further detail. As described above, when the advantages of the first part 303*b* are considered, the blade 303 can be made practical using only rearward-inclined surfaces for concentrating the projection pattern. However, projection speed relative to rpm declines to the degree the blades are inclined rearwardly, therefore to increase projection speed requires raising the rpm. Increasing the rpm causes problems such as a rise in power consumption or a rise in noise when projection material is not being projected. By measures such as placement of a bent portion on the outside of the first part 303*b* serving as a shot receiving portion, it was able to concentrate the projection pattern without changing projection power efficiency by adopting a constitution using blades 303 (accurately stated, the blades 303 explained in FIGS. 13A-13F and 14A-14D) wherein the second part 303*c*, which in substance performs the blade projection, is inclined further forward than the first part 303*b*, which is the receiving portion. This enabled the projection speed relative to rpm to be increased using the second part 303*c* of the blades 303.

The inclined angle θ1 on the first part 303*b* of the blades 303 will be explained in further detail. As described above, 30°-50° is favorable for the rearwardly inclined angle of for the first part 303*b*, i.e., the inclined angle θ1 relative to plane P1. As described above, on the blades 303 the projection pattern is concentrated by gathering continuously supplied projection material in the first part 303*b*, but if the angle is less than 30°, the time difference in riding on the blades is shortened, and the degree of distribution concentration is reduced. Above 50°, the time difference becomes too large, and projection material which has landed on the blades close to the blade stem passes projection material received at the tip portion of the blades and is projected first, reducing effectiveness. Since the length of the first part 303*b* increases as the blades are inclined rearwardly, blades become heavier, increasing parts cost, reducing workability, and so forth. An appropriate range of angles is determined based on the reasons above.

It happens that the above-described projection surface 303*a* is also the surface on which the earlier explained projection material 302 moves. The projection back surface 303*q* is also opposite the surface on which the projection material 302 moves. The blade projection portion 303*g* may be said to be at least in part sandwiched between this projection surface 303*a* and the projection back surface 303*q*. The attachment portions 303*h* are members for attaching and fixing the blades 303 to the pair of side plates 311. The shape of the attachment portions 303*h* and the guide channel portion 313 is not limited to that described above, but should be constituted so that the blades 303 are mechanically attachable and detachable from the side plate unit 310. It is desirable for the combination of the side plate unit 310 and blades 303 to be fixed by centrifugal force as described above, for example.

In the centrifugal projector 301 and blades 303 used for same, constituted as described above, the projection material projection pattern can be concentrated, and projection efficiency can be increased in a narrow projection range. That is, the projection pattern is concentrated, therefore the number of shot pieces not hitting the product can be reduced and projection efficiency improved when the processing target is small.

Thus by careful investigation of the overall motion of projection material supplied to each blade, it has been possible to identify for the first time the optimal constitution for the centrifugal projector 301 and blades 303. Previous efforts sought to study the motion of projection material one ball at a time to increase acceleration characteristics. This constitution of the centrifugal projector enables concentration of the motion of all projection material to concentrate the projection pattern. High efficiency projection is thus enabled.

In addition, the above-described side plate unit 310 and centrifugal projector 301 in which it is used can concentrate the projection material projection pattern so that projection efficiency relative to a narrow projection range can be increased, and the following effects obtained. That is, blades 303 with the above-described types of effect can be easily and securely attached and replaced.

Note that the blades used in a centrifugal projector 301 used in an embodiment of the invention are not limited to the blades 303 shown in the above-described FIGS. 13A-13F and 14A-14D. It is sufficient that they be constituted to have at least one of the above-described effects. Specifically, the blades 307 shown in FIGS. 20A-20F and 21A-21D may also be used as blades for the centrifugal projector 301. Note that with respect to the above-described blades 303, the blades 307 have essentially the same constitution and effect as the blades 303, other than not having the raised portion 303*r* and raised portion 303*r*. Parts with the same constitution, function, and effect are identified with the same names and similar reference numerals (reference numerals following "303" and "307" are shared in common), and a detailed explanation thereof is omitted.

As shown in FIGS. 20A-20F and 21A-21D, the projection surface 307*a* on the blades 307 has a first part 307*b*, being the inside part of the projection surface 307*a* in the radial direction, and a second part 307*c*, being the outside part of the projection surface 307*a*, positioned on the outside of the first part 307*b* in the radial direction. The blade 307 second part 307*c* is disposed as an integral part of the first part 307*b*, mediated by a bent or curved portion relative to the first part 307*b*. Note that in the example explained here, mediation is through a curved portion 307*d*.

In the same way as the above-described first part 303*b*, the first part 307*b* of the blades 307 is formed at a pitch so that its radial outer side is positioned further behind its inner side in the rotational direction R1. In the same way as the above-described second part 303*c*, the second part 307*c* is formed so that it is positioned further to the front in the rotational direction than an imaginary line extending the first part 307*b* outward.

The blades 307, like the blades 303 described above, have a blade projection portion 307*g* with a projection surface 307*a* for projecting projection material, and a pair of attachment portions 307*h* positioned on the two edge portions of this blade projection portion 307*g*. In the attachment portions 307*h*, at least the outside part 307*i* thereof is formed in a straight shape. The blade projection portion 307*g* has a curved or bent shape, but the majority of the outside part of the attachment portions 307*h* (the majority of the inside part described below) is considered as straight part 307*h*3.

The blades 307 attachment portions 307*h* have a locking portion 307*j* on the inside part thereof. The locking portion 307*j* is formed to protrude from the above-described straight shape. In addition, plurality of contacting portions 307*k* is disposed on the outside of the pair of attachment portions 307*h*. The contacting portions 307*k* are formed to project from the outside surface 307*m* of the attachment portions 307*h*. Note also that on the blades 307, the entire outer surface of the locking portion 307*j* is a contacting portion 307*k*. The blade projection portion 307*g* and attachment portions 307*h* are formed so that the spacing L9 of the inside surfaces 303*h*1 opposing the pair of attachment portions 303*h* becomes gradually smaller toward the outside with respect to the inside (center direction) in the radial direction. The relationship between the outer surface 307*h*2 of attachment portions 307*h*, both edge portions 307*g*1 on the blade projection portion 307*g*, and so forth is also as explained above for the blades 303.

Also, as was the case for the above-described blades 303, the second part 307*c* of the blades 307 is formed so that the imaginary line connecting the rotational center of the blades 307 and a point close to the outside edge portion of the second part 307*c* matches the normal line, therefore the above-described projection material acceleration capability can be demonstrated. Here the imaginary line (same as the imaginary line L2 shown in FIGS. 15A-15C using blades 303) connecting the rotational center of the blades 307 and the outer end portion 307*n* of the second part 307*c* is formed to match the normal line.

The inner end portion 307*p* of the blade projection portion 307*g* on the blades 307 is formed in an inwardly tapered shape, as described above relative to the blades 303 and, by expanding the distance between the inner end portions 30'7*p* between each of the blades 307, can function as guide portions for increasing the amount of projection material guided between the rotating blades 307.

As described above, the blades 307 have essentially the same constitution as the blades 303, except for not having projecting portions and associated structures on the projection back surface 307*q*. The projection back surface 307*q* is formed in a curved shape (a curved shape without a bent portion) except for the taper-forming portion 307*u*. The taper-forming portion 307*u* forms the above-described first part 307*b* and the above-described tapered end portion 307*p*. Note that the taper-forming portion 307*u* here was formed in a planar shape, but it may also be formed in a curved shape, i.e., as a portion of the curved surface formed in the projection back surface 307*q*.

Using the centrifugal projector 301 and blades 307 used for same constituted as described above, the projection material projection pattern can be concentrated, and projection efficiency increased with respect to a narrow projection range. Parts of the blades 307 with the same constitution as the blades 303 provide the effects obtained from that constitution.

The same effects of the above-described blades 303, 307 themselves can be demonstrated even if, for example, the side plate unit, distributor, control cage, or other parts differ in constitution from what was described above. For example, for side plates used for both these blades 303 and 307, the side plate is not limited to the above-described pair of side plates, but may also be, for example, a single side plate.

Next, referring to FIGS. 22A-22N, a variant example of a control cage used in a centrifugal projector 301 will be explained. That is, a control cage will be explained, used simultaneously with the above-described blades 303, 307, from which a synergistic effect is obtained. The above-described control cage 321, as shown for example in FIG. 22A, has a rectangular opening window 321*a*. The control cage used in the centrifugal projector 301 is not limited to the above.

The control cage used in the centrifugal projector 301 may have two or more opening windows selected from among square or triangular opening windows. In addition to having two or more opening windows selected from among square or triangular opening windows, it is also acceptable to have a single opening window formed as a single piece by partially overlapping all or a part of these opening windows. Examples mentioned here of squares include rectangles (rectangles or regular squares) or other parallelogram, etc. Specifically, the control cage 341 shown in FIG. 22B may be used as the control cage for the centrifugal projector 301.

The control cage 341 shown in FIG. 22B has two square opening windows 341*a* and 341*b*. Except for the constitution of the opening window, the control cage 341 comprises the same constitution as the above-described control cage 321, so a detailed explanation thereof is here omitted.

Here the advantages of FIG. 22B, which is the example of a control cage from which a synergistic effect is obtained using the blades 303 and 307 simultaneously, will be explained. In the step whereby projection material from the above-described control cage is scatter-released, projection material is supplied in a phase-differentiated manner from the opening windows 341*a*, 341*b*. This enables the composition of a projection pattern; uniform processing is applied to the processing targets, and the total amount of projection required for processing can be reduced.

Details of phase differentiation in the control cage opening window are now explained. Projection material is continuously released from the control cage opening window. Here, as shown in FIG. 22B, the opening windows 341*a* and 341*b* are provided on the control gate 341; when positioned in the circumferential direction, an offset occurs in each of the respective projections. That is, the offset positioning of the opening windows 341*a* and 341*b* results in a positional offset between the projection material which leaves the first opening window 341*a* and the projection material which leaves the second opening window 341*b*. That projection offset becomes a phase difference, which results in the composition of a projection pattern. That is, in the shot scatter-release step of the centrifugal projection method when the control cage 341 is used, a phase difference (projection offset) in the scatter-released projection material is caused to occur by releasing projection material from two opening windows.

The composition of the pattern created by this control cage 341 can also be performed by blades other than the blades 303 or 307. However, if the original projection pattern is broad, the result will be merely a broad projection, even if the composition is offset therefrom, and no advantage will be gained. In general, a square opening window is used to narrow the original distribution (the distribution of the respective opening portions). Also, the supplying of projection material with a phase differential from the control cage can itself also be achieved by changing the shape of the opening window. For example, the shape of the control cage opening window may be made rectangular (rectangular or square). By so doing, the timing at which projection material is supplied from the control cage to the blades is simultaneous in the blade width direction. On the other hand, a method is also conceivable in which, by using a triangular or other shape for the opening window, the timing at which projection materials are supplied to the blades can be offset across the blade width direction. The present inventors have discovered that a parallelogram is preferable when processing a flat panel. As described above, the control cage 341 has good compatibility with the blades 303 and 307, which are able to concentrate and narrow the projection pattern. That is, by composing a projection pattern concentrated by the blades 303, 307, the control cage 341 is able to increase the amount of projection within the total range of the processing target.

In other words, by composing a pattern using the above-described blades 303, 307 and the control cage 341, etc., a projection pattern fitting the product, which is the processing target, can be formed. Specifically, after gathering projection material on the blades to concentrate the projection pattern, any desired projection pattern may be set using a technology for composing distributions, such as the control cage 341, and the fraction of projection material resulting in processing variability or not hitting the product can be reduced.

A centrifugal projector 301 using a control cage 341 raises projection efficiency and achieves a reduction in the total amount of projection material required for product processing. That is, if there is projected projection material which does not hit the product, or a larger fraction of projection material hits the product than required, then even if the projection material acceleration efficiency improves, there will be an increase in the total projection amount, and efficiency in performing the targeted processing cannot be said to rise very much. Depending on the product, there were some cases in which only about ⅕ of the projected projection material contributed to processing the product. A centrifugal projector 301 with these improved blades 303, 307 and control cage 341 has a dramatic effect.

Figure 23:
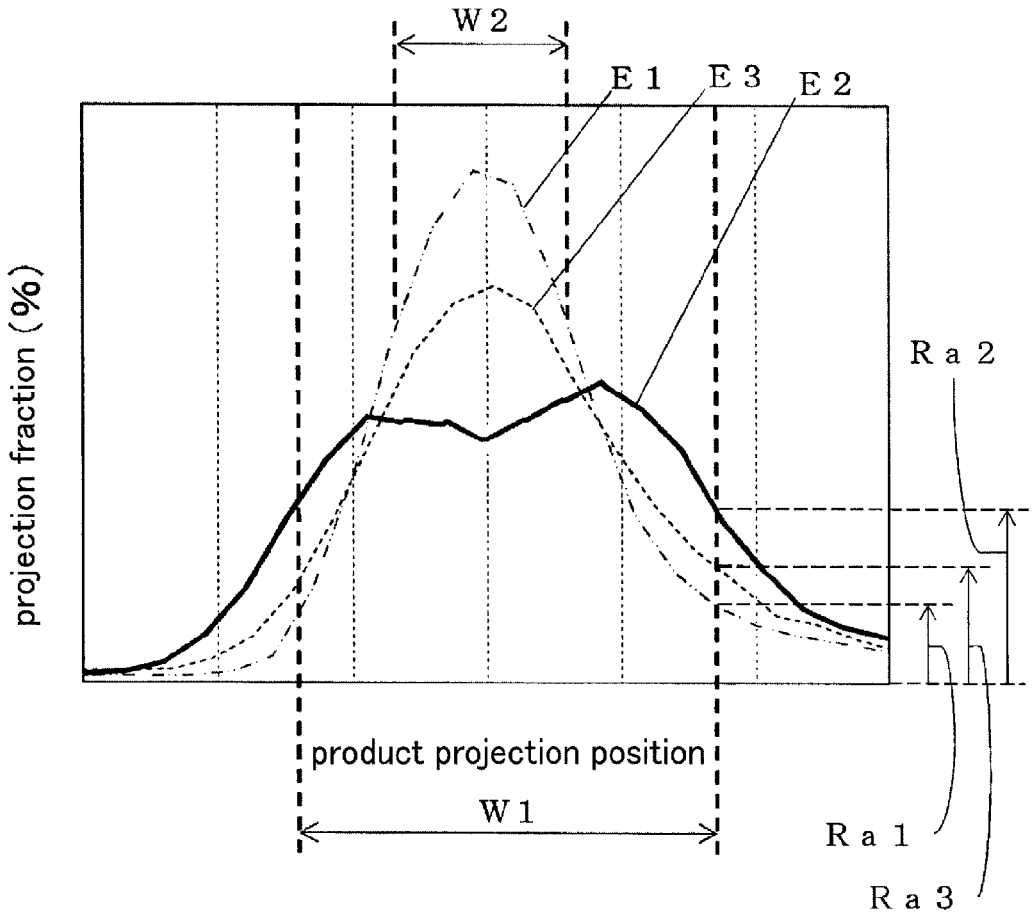
FIG. 23 is a diagram showing the distribution of projection ratios in centrifugal projectors according to test examples 1 and 2, and a comparative example of the present invention.

Here, referring to FIG. 23, the advantages of the blades 303, 307 and the control cage 341 using test examples will be explained. FIG. 23 is a diagram showing what percentage of the total projected projection material is projected onto which part of the product (processing target). FIG. 23 may also be said to show the projection pattern relative to a product. The horizontal axis shows the product projection position. The vertical axis shows the projection fraction and percentage of total.

In FIG. 23, E3 shows the results of a comparative example. In the comparative example, results are shown using the above-described conventional blades, i.e., blades with a projection surface having an essentially flat surface (the surface on plane P1), and a control cage with a single opening window. E1 shows the results of test example 1. Test example 1 is the result obtained using the blades 303 shown in FIGS. 20A-20F and 21A-21D and a control cage (e.g., FIG. 22A) having a single opening window. E2 shows the results of test example 2. Test example 2 is a result obtained using the blades 303 and a control cage (e.g., FIG. 22B) having two opening windows. Note also that E1, E2, and E3 show test results.

In FIG. 23, W1 shows the product (processing target) range; i.e., the projection range on the product. Ra3 shows the minimum projection fraction within the range of a processing target in a comparative example. Ra1 shows the minimum projection fraction within the range of a processing target in test example 1. Ra2 shows the minimum projection fraction within the range of a processed part in test example 2.

In FIG. 23, the maximum value of the projection fraction in the test example 1 projection pattern is high with respect to the projection pattern in the comparative example, while on the other hand the fraction is low in other parts, so it can be confirmed that the projection is concentrated.

When the rejection amount is equal, the processing time for the processed part lengthens in inverse proportion to the lowest projection fraction. When the product range is W1, Ra3>Ra1, therefore the processing time is shorter for the comparative example than for the test example 1. When composing a projection pattern such as that in example 2, there are two peaks within W1, and adjustment can be made to achieve an overall flat projection pattern. In the test example 2 case, Ra2>Ra3, and processing time is much shorter in test example 2 than in the comparative example. Note that in the comparative example, because the distribution is broad, overall efficiency is low even if there are two opening windows; i.e., shot not hitting the processed part increases and processing time increases further. This means that for processed parts such as those shown by W2, for example, projection efficiency is highest and processing time is shortened in test example 1.

In the W1 product case, as described above, test example 2 is most superior. Thus projection of the required amount of projection material onto the necessary parts means that processing time can be shortened and projection amounts can be reduced. Electrical power used for projection can thus be reduced, and furthermore power used to circulate shot can be reduced by reducing the amount of projection material in circulation; projection material abrasion can also be reduced. In addition, abrasion of projection material and of the liner caused by impact on the liner inside the projection chamber (a projection chamber in a surface treatment apparatus using a centrifugal projector 301) by projection material not hitting the product can also be reduced.

As described above, there is extremely good compatibility between a control cage with plurality of opening windows and the blades 303 and 307 which enable concentration of the above-described projection pattern. Also, with a control cage enabling the composition of such a projection pattern, and blades 303 and 307, the projection pattern of projection material can be concentrated and adjustments made to achieve a projection pattern appropriate to the processed part, thereby increasing projection efficiency. That is, processing variability and projection material not hitting the processing targets can be reduced, as can the total amount of projected projection material.

Starting in FIG. 23, the projection amounts required for each product are determined according to set processing conditions. Ideally, if shot is uniformly projected onto the processed surface, one may say that the quality of the processed surface is also uniform and that no wasted projection occurs. In reality, however, because the projection pattern is not uniform, projection density differed between locations on the product, and processing variability occurred. Also, it could occurred that the large number of shot did not hit the product, and depending on the product and apparatus, less than 20% of the projected shot contributed to the quality of product processing. In response to this, projection efficiency can be raised using a centrifugal projector 301 comprising the above-described blades 303, 307 and control cage 341, and the centrifugal projection method using same.

Next, referring to FIGS. 22A-22N, it will be explained variant examples of the control cage used in a centrifugal projector 301 used in an embodiment of the present invention, as well as the operational effects of changes to the control cage. The control cage used simultaneously with the above-described blades 303, 307, from which a synergistic effect is obtained may also be the control cage 342, 343, 344, or 345 according to FIGS. 22C-22F, in addition to the above described FIGS. 22A and 22B. Below we explain these control cages 342-345, but except for the constitution of the opening window, these comprise the same constitution as the above-described control cage 321, so a detailed explanation thereof is here omitted.

The control cage 342 shown in FIG. 22C has a single opening window 342*x*, integrated as a single piece by the partial overlapping of parts of two rectangular opening windows. The opening window 342*x* has rectangular parts 342*a*, 342*b* constituting a window. For example, the sizes of the rectangular parts 342*a*, 342*b* are assumed to be the same as the size of the opening windows 341*a*, 341*b*. The control cage 343 shown in FIG. 22D has a parallelogram-shaped opening window 343*a*.

The control cage 344 shown in FIG. 22E has rectangular and parallelogram-shaped opening windows and has three such opening windows, and has a single opening window 344*x* which is integrated into a single piece by the partial overlap of a portion of these opening windows. The opening window 344*x* has a rectangular part 344*a*, a parallelogram-shaped part 344*b*, and a rectangular part 344*c*, forming a window, and is integrated as a single piece, positioned in this order. The control cage 345 shown in FIG. 22F has five rectangular opening windows, and has an opening window 345*x*, integrally formed as a single piece by the partial overlap of a portion of these opening windows. The opening window 345*x* has a rectangular part 345*a*, a rectangular part 345*e*, and narrow width rectangular parts 345*b*, 345*c*, and 345*d* positioned between the above, together constituting a window. The sizes of the rectangular parts 345*a*, 345*e* are, for example, essentially the same as the sizes of the rectangular parts 344*a*, 344*c*. The positions and sizes of the area combining the rectangular parts 345*b*, 345*c*, and 345*d* are, for example, essentially the same as the positions and sizes of the parallelogram-shaped part 344*b*.

Next, referring to FIGS. 22A-22N, it will be explained variant examples of the control cage used in a centrifugal projector 301 used in an embodiment of the present invention, as well as operational effects of changing the control cage. Note that FIGS. 22A-22F are side elevations of a control cage with a cylindrical shape (diagrams show an opening window placed in the side surface); FIGS. 22G-22N show the case when the blades, etc., rotate in the direction of the arrow in FIGS. 22A-22N when the control cage shown in FIGS. 22A-22F is viewed from the left side (the hopper side), i.e., when blades passing through the window on each control cage rotate from down to up on the FIGS. 22A-22N paper surface.

First, the area through which projection material passes when the FIG. 22A control cage 321 is used is shown by B0 in FIG. G; the area on the processed surface where projection material hits is shown by BA0 in FIG. 22H, and the projection pattern (distribution) is shown by BL0 in FIG. 22G. Note that "area on the processed surface where projection material hits" means the "area where projection material hits" assuming the processed surface is on a plane essentially perpendicular to the direction in which the projection material is projected. The opening window 321*a* shown in FIG. 22A is one in general use.

The area through which projection material passes when the FIG. 22D control cage 343 is used is shown by B3 in FIG. 22K; the area on the processed surface where projection material hits is shown by BA3 in FIG. 22L, and the projection pattern (distribution) is shown by BL3 in FIG. 22K. The opening window 343 shown in FIG. 22D is a parallelogram; since the timing at which projection material is supplied from the control cage 343 to the blades is offset in the width direction of the blades, the projection pattern is softened. The processing target processing time lengthens in inverse proportion to the lowest projection fraction, therefore depending on the shape of the product this may be more advantageous than the case of FIG. 22A.

In other words, the control cage 343 has a parallelogram-shaped opening window 343*a*; in the parallelogram of this opening window 343*a*, because the position in the circumferential direction is offset from the position in the direction parallel to the rotary shaft of the mutually opposing sides formed in the circumferential direction, the positional relationship seen on the side of the control cage 343 (the positional relationship shown in FIG. 22D) is one of diagonal alignment, therefore an appropriate projection pattern is obtained. This constitution, by its use together with the concentrating performance of the blades 303, 307, has the effect of increasing projection efficiency relative to the product. Additionally, by applying the same thought as applied when providing this parallelogram, it is also acceptable to provide a triangular opening window, or to provide an opening window combining a triangular opening window and a square opening window, or an opening window integrating parts thereof into a single entity.

The areas through which projection material passes when the FIGS. 22B and 22C control cages 341, 342 are used are shown by B1*a*, B1*b* in FIG. 22I; the areas hit by the projection material on the processed surface are shown by BA1*a*, BA1*x*, and BA1*b* in FIG. 22J, and the projection pattern (distribution) is shown by BL1*x* in FIG. 22I. Area B1*a*, projection pattern BL1*a*, and area BA1*a* correspond to the opening window 341*a* (rectangular part 342*a*). Area B1*b*, projection pattern BL1*b*, and area BA1*b* correspond to the opening window 341*b* (rectangular part 342*b*). The overlapping part of areas B1*a*, B1*b* is area B1*x*. The overlapping part of areas BA1*a*, BA1*b* is area BA1*x*. The synthesis (adding together) of projection pattern BL1*a* and BL1*b* is the projection pattern BL1*x*, which may be described as the projection pattern when these control cage 341 and 342 are used.

The control cages 341, 342 have two or more opening windows, or have a single opening window integrating two or more opening windows, therefore the projection pattern can be adjusted to a desired pattern by composing the projection pattern. The processing target processing time lengthens in inverse proportion to the lowest projection fraction, therefore depending on the shape of the product this may be more advantageous than the cases of FIG. 22A and FIG. 22D.

In other words, the control cages 341, 342 either have two rectangular opening windows 341*a*, 341*b*, or have two rectangular opening windows (rectangular parts 342*a*, 342*b*) and have a single opening window 342*x* integrating a partial overlap of those windows. Because the position in the circumferential direction and the position in the direction parallel to the rotary shaft are offset in the two rectangles (opening windows 341*a*, 341*b*) (rectangular parts 342*a*, 342*b*), the positional relationship (positional relationship in FIGS. 22B and 22C) seen in the side surfaces of the control cages 341, 342 is one of diagonal alignment, therefore an appropriate projection pattern (desired projection pattern) is obtained. This constitution, by its use together with the concentrating performance of the blades 303, 307, has the effect of increasing projection efficiency relative to the product.

The areas through which projection material passes when the FIGS. 22E and 22F control cages 344, 345 are used are shown by B4*a*, B4*b*, B4*x*, and B4*c* in FIG. 22M; the areas hit by the projection material on the processed surface are shown by BA4*a*, BA4*x*, and BA4*c* in FIG. 22N, and the projection pattern (distribution) is shown by BL4*x* in FIG. 22M. Area B4*a*, projection pattern BL4*a*, and area BA4*a* correspond to opening window 344*a* (rectangular part 345*a*). Area B4*c*, projection pattern BL4*c*, and area BA4*c* correspond to opening window 344*c* (rectangular part 345*e*). The overlapping part of areas B4*a*, B4*c* is area B4*x*. The overlapping part of areas BA4*a*, BA4*c* is area BA4*x*. The synthesis (adding together) of projection pattern BL4*a* and BL4*c* is a projection pattern BL4*x*, which may be described as the projection pattern when these control cage 344 and 345 are used.

The control cages 344, 345 have a single opening window integrating three or more opening windows, therefore the projection pattern can be adjusted to a desired pattern by composing the projection pattern. Specifically, the projection pattern BL1*x* described using FIG. 22I forms an M shape; i.e., the projection fraction is slightly less in the part between two peaks. By placement of a parallelogram part 344*b* in the case of FIG. 22E, or placement of plurality of rectangular parts 345*b*, 345*c*, and 345*d* in the case of FIG. 22F, between the rectangular parts 344*a*, 344*c* (rectangular parts 345*a*, 345*e*) corresponding to the opening windows 341*a*, 341*b* (rectangular parts 342*a*, 342*b*) in FIGS. 22B and 22C, the projection fraction of the part between the two peaks can be adjusted upward. The processing time of processing target lengthens in inverse proportion to the lowest projection fraction, therefore depending on the shape of the product this may be more advantageous than the FIG. 22A through FIG. 22D cases. Also, a projection pattern can be obtained in which processing variability is reduced as much as possible.

In other words, the control cage 344 has a single integrated opening window 344*x* in which three squares (parts 344*a*, 344*b*, 344*c*) are partially overlapped. In the positional relationship seen on the side of the control cage 344*x* (positional relationship in FIG. 22E), the opening window 344*x* has a diagonally aligned first rectangular part 344*a* and a second rectangular part 344*c*, and a parallelogram part 344*b* placed between the first rectangular part 344*a* and the second rectangular part 344*c*. The first rectangular part 344*a*, the second rectangular part 344*c* and the parallelogram part 344*b* are respectively offset in positions in the circumferential direction and positions in the direction parallel to the rotary shaft. By this constitution, an appropriate projection pattern (desired projection pattern) is obtained. This constitution, by its use together with the concentrating performance of the blades 303, 307, has the effect of increasing projection efficiency relative to the product.

The control cage 345 has a single integrated opening window 345*x* in which five squares (this will be explained as having parts 345*a* through 345*e*, but the same effect is demonstrated by partially overlapping four or more squares). In the positional relationship seen on the side of the control cage 345 (the positional relationship in FIG. 22F), the opening window 345 has a diagonally aligned first rectangular part (345*a*) and a second rectangular part (345*e*), and a rectangular part group formed of plurality of rectangular parts 345*b*, 345*c*, and 345*d* placed between the first rectangular part (345*a*) and second rectangular part (345*e*); this first rectangular part (345*a*), second rectangular part (345*e*), and rectangular part group formed of plurality of rectangular parts 345*b*, 345*c*, and 345*d* are respectively offset in their rotational direction positions and their positions in the direction parallel to the rotary shaft. In addition, the rectangular part group formed of plurality of rectangular parts 345*b*, 345*c*, and 345*d* are also offset in their rotational direction positions and their positions in the direction parallel to the rotary shaft, and are formed to line up diagonally when viewed on the side of the control cage 345. The rectangular parts 345*b*, 345*c*, and 345*d* which comprise this rectangular part group are formed so that their length in the direction parallel to the rotary shaft is smaller than the first rectangular part and the second rectangular part (345*a*, 345*e*). By this constitution, an appropriate projection pattern (desired projection pattern) is obtained. This constitution, by its use together with the concentrating performance of the blades 303, 307, has the effect of increasing projection efficiency relative to the product.

As described above, a control cage having either two or more opening windows, or a having two or more opening windows and having a single opening window integrated by the partial overlap of either the entirety of these opening windows or respective parts thereof, is capable of adjusting the projection pattern. The control cage produces the synergistic effect of blades 303 and 307, which concentrate the projection pattern; in other words it is capable of increasing the projection amount in the overall range of the processing target. It also reduces product processing variability and reduces the fraction of projection material not hitting the product, raising the projection material projection efficiency.

Note that the above embodiments and the aforementioned multiple variant examples may also be combined as appropriate.

What is claimed is:

1. A shot processing apparatus comprising:

a generally cylindrical drum shaped to have an open one end and a closed other end;

a centrifugal projector arranged rotatable by a rotary shaft to throw a blasting material out therefrom into the open one end of the generally cylindrical drum;

a blade wheel provided in the centrifugal projector and having a plurality of blades rotatable in a first rotational direction around a rotational axis, the plurality of blades being configured to receive the blasting material and throw the received blasting material out of the centrifugal projector by operation of centrifugal force generated by its rotation in the first rotational direction around the rotational axis, wherein each blade comprises a front surface facing in the first rotational direction and a rear surface facing in a second rotational direction opposite to the first rotational direction, the front surface being bifurcated into radially contiguous first surface and second surface arranged, respectively, on radially inner and outer sides of the front surface, the first and second surfaces both being inclined in the second rotational direction at first and second angles, respectively, with respect to a radius of the blade wheel, the second angle being smaller than the first angle with respect to the radius of the blade wheel, and wherein each blade is formed with a pair of planar side walls having front edges and rear edges and extending perpendicularly to the rotational axis through a radial length of the blade along circumferential sides of the front surface, the front edges being shaped straight throughout its radial length and projecting generally in the first rotational direction from the circumferential sides of the front surface, the rear edges being shaped straight in parallel to the front edges except radially inner end portions thereof from which locking portions project in the second rotational direction; and a pair of circular side plates provided in the centrifugal projector in parallel to each other along the rotational axis and arranged to secure the plurality of blades between them, the pair of circular side plates being formed in their opposing surfaces with guide channels at equal angular intervals, the guide channels extending radially outward and being inclined in the second rotational direction at a third angle from the radius of the circular side plates, the guide channels being shaped to securely receive the plate side walls of the blades wherein at least one of the guide channels of each circular side plate is provided with a recessed portion formed in the guide channel and with an insertion hole formed in a bottom of the recessed portion, the insertion hole running through the circular side plate, and wherein the pair of circular side plates are attached to the rotary shaft by bolts inserted through the insertion hole with heads of the bolts being hidden within the recessed portions.

2. The shot processing apparatus of claim 1 wherein the first surface is longer than the second surface measured along a length of the front surface extending radially outwardly.

3. A shot processing apparatus of claim 1, further comprising:

a cabinet configured to house the generally cylindrical drum and comprising a infeed/outfeed port arranged for a workpiece to be loaded and unloaded therethrough into the generally cylindrical drum, and a positioning machine operable to move the generally cylindrical drum and selectively position it at multiple positions including a workpiece loading position at which the workpiece is loaded in the generally cylindrical drum, a blasting position at which the open one end of the generally cylindrical drum is oriented to face the centrifugal projector and receive the blasting material therefrom and a workpiece unloading position at which the workpiece is discharged from the generally cylindrical drum.

4. The shot processing apparatus of claim 1 further comprising:

a drum lid movable to close or open the open one end of the generally cylindrical drum, the drum lid being configured to secure the centrifugal projector thereon;

a movement mechanism operable to move the drum lid and position it at multiple positions including a closing position at which the drum lid is positioned to close the open one end of the generally cylindrical drum and the centrifugal projector throws the blasting material into the generally cylindrical drum through the open one end thereof, and a retracted position at which the drum lid is positioned away from the open one end of the generally cylindrical drum so as not to interfere with loading and unloading of a workpiece in and from the generally cylindrical drum; and a rotating mechanism operable to rotate the generally cylindrical drum and position the open end of the generally cylindrical drum at multiple positions including a loading position at which the open one end of the generally cylindrical drum is oriented upward to receive the workpiece and the blasting material therethrough in the generally cylindrical drum and unloading position at which the open one end of the generally cylindrical drum is oriented downward to unload the workpiece from the generally cylindrical drum.

* * * * *